US006010124A

United States Patent [19]

Higashikawa et al.

[11] Patent Number: 6,010,124

[45] Date of Patent: Jan. 4, 2000

[54] SHEET CONVEYING APPARATUS

[75] Inventors: Koji Higashikawa, Kumamoto; Satoshi Fujii, Toyohashi; Hiroki Nishikubo, Aichi-Ken, all of Japan

[73] Assignee: Minolta Co., Ltd., Osaka, Japan

[21] Appl. No.: 09/017,501

[22] Filed: Feb. 2, 1998

[30] Foreign Application Priority Data

Feb. 3, 1997 [JP] Japan ..... 9-020440

[51] Int. Cl.[7] ..... B65H 5/22

[52] U.S. Cl. ..... 271/3.02; 271/3.05; 271/3.13; 271/171

[58] Field of Search ..... 271/3.02, 3.05, 271/3.13, 171, 223, 207, 209; 399/377; 414/770.3

[56] References Cited

U.S. PATENT DOCUMENTS

| | | | |
|---|---|---|---|
| 3,944,794 | 3/1976 | Reehil et al. . | |
| 4,278,344 | 7/1981 | Sahay | 271/3.05 |
| 4,379,549 | 4/1983 | Mizuka | 271/3.02 |
| 4,739,369 | 4/1988 | Yoshiura et al. . | |
| 4,786,039 | 11/1988 | Ito | 271/3.02 |
| 4,905,044 | 2/1990 | Hamano . | |
| 4,908,673 | 3/1990 | Muramatsu . | |
| 4,956,651 | 9/1990 | Emori . | |
| 4,957,285 | 9/1990 | Yamada | 271/3.05 |
| 5,008,709 | 4/1991 | Shinada et al. . | |
| 5,031,003 | 7/1991 | Hamano . | |
| 5,084,741 | 1/1992 | Takemura et al. . | |
| 5,201,505 | 4/1993 | Shah | 271/207 |
| 5,280,897 | 1/1994 | Maekawa | 271/223 |
| 5,327,206 | 7/1994 | Ueda et al. . | |
| 5,460,360 | 10/1995 | Kotani et al. . | |
| 5,559,594 | 9/1996 | Ohhata et al. . | |
| 5,754,934 | 5/1998 | Kamezaki et al. | 271/3.05 |

FOREIGN PATENT DOCUMENTS

| | | | |
|---|---|---|---|
| 402295853A | 12/1990 | Japan | 271/3.05 |
| 06138737 | 5/1994 | Japan . | |
| 06148976 | 5/1994 | Japan . | |
| 06148977 | 5/1994 | Japan . | |
| 06148978 | 5/1994 | Japan . | |
| 06148979 | 5/1994 | Japan . | |

*Primary Examiner*—H. Grant Skaggs
*Attorney, Agent, or Firm*—McDermott, Will & Emery

[57] ABSTRACT

The preset invention relates to a sheet conveying apparatus equipped with a tray which couples feed port and discharge port to each other by a continuous surface. The tray comprises a first surface adjacent to the feed port for placing thereon sheets to be fed, a second surface adjacent to the discharge port for placing thereon discharged sheets, the second surface being tilted up so that the front end of the discharged sheet is positioned upper than the rear end thereof, and a bent portion at which the end of the first surface at the discharge side and the end of the second surface at the feed side are coupled to each other. A length of the first surface ranging from the bent portion to the feed port in the sheet conveyance direction is larger than one half of the length of a feedable maximum size sheet in the sheet conveyance direction. A length of the second surface ranging from the discharge port to the bent portion in the sheet conveyance direction is larger than one half of the length of a feedable minimum size sheet in the sheet conveyance direction.

12 Claims, 31 Drawing Sheets

SHEET CONVEYING APPARATUS

This application is based on application No. 9-20440 in Japan, the contents of which is hereby incorporated by reference.

BACKGROUND OF THE INVENTION

The present invention relates to a sheet conveying apparatus equipped with a sheet tray which couples feed port and discharge port to each other in a continuous surface, more specifically to a configuration of the sheet tray.

Conventionally, there are two types of sheet conveying apparatus. One is a type that a feed tray and a discharge tray are equipped separately, the other is a type that an integral form of sheet tray which couples feed port and discharge port to each other in a continuous surface is equipped.

The sheet conveying apparatus equipped with the separate-type trays has a disadvantage that it is difficult to set or remove the sheet in such case that the discharge tray is positioned above the feed tray or that the feed tray is positioned above the discharge tray.

The sheet conveying apparatus equipped with the integral-type tray has a disadvantage that it is difficult to remove the sheet due to the flatness of the tray when resetting the sheet after jam correction process and when picking up the discharged sheet. When the sheet is long in length, the front end of the discharged sheet touches the rear end of the unfed sheet, which prevents the front end of all discharged sheet from matching each other. In addition, in the case that the sheet is curled upward, the next sheet is prevented from discharging. Therefore, the apparatus has a disadvantage that it is necessary to elongate the integral tray in the conveyance direction and enlarge the difference of the height between the discharge port and the tray, which makes the apparatus large-sized.

The sheet conveying apparatus equipped with the integral-type tray in which the discharge side is lower than the feed side has a further disadvantage that the sheet is liable not to be in the right place when setting the sheet or resetting the sheet in recirculation mode, and that the sheet moves due to the vibration of machine and another external factor at the time of feed operation to induce the sheet feed jam.

Moreover, The sheet conveying apparatus equipped with the integral-type tray has a further disadvantage that, since the distance in the feed side between sheet restricting plates positioned both side of the sheet conveying direction is the same as that in the discharge side, the discharged sheet is not directed to the position between the sheet restricting plates due to the skew or the deviation from the reference position of the discharged sheet.

SUMMARY OF THE INVENTION

The present invention has been accomplished in view of these and other problems. An object of the invention is to provide a sheet conveying apparatus which is easy to pick up the sheet from the tray, hard to deviate from the reference position, easy to convey the sheet, low-priced and small-sized.

In order to achieve the above object, according to the present invention, there is provided a sheet conveying apparatus equipped with a tray which couples feed port and discharge port to each other by a continuous surface, in which apparatus the tray comprises a first surface adjacent to the feed port for placing thereon sheet to be fed, a second surface adjacent to the discharge port for placing thereon discharged sheets, the second surface being tilted up so that the front end of the discharged sheet is positioned upper than the rear end thereof, and a bent portion at which the end of the fir;t surface at the discharge side and the end of the second surface at the feed side are coupled to each other, wherein a length of the first surface ranging from the bent portion to the feed port in the sheet conveyance direction is larger than one half of the length of a feedable maximum size sheet in the sheet conveyance direction, and wherein a length of the second surface ranging from the discharge port to the bent portion in the sheet conveyance direction is larger than one half of the length of a feedable minimum size sheet in the sheet conveyance direction.

According to the sheet conveying apparatus of the present invention, since the length of the first surface ranging from the bent portion to the feed port in the sheet conveyance direction is larger than one half of the length of a feedable maximum size sheet in the sheet conveyance direction, the sheets of the maximum size or smaller set on the first surface of the tray have a center of gravity on the feed side of the bent portion. Therefore, when setting the sheet or resetting the sheet for refeed, the sheet is prevented from shifting or moving toward the upstream side (discharge port side) due to vibrations of the machine during the sheet feed operation. Also, even sheets having such size as the discharged sheets are overlapping on fed sheets can be prevented from misalignment of discharged sheets because the rear end side of the fed document is directed downward at a boundary of the bent portion so that the front end of the discharged sheet will never contact the rear end of the fed sheet. Moreover, according to the sheet conveying apparatus of the present invention, since a length of the second surface ranging from the discharge port to the bent portion in the sheet conveyance direction is larger than one half of the length of a feedable minimum size sheet in the sheet conveyance direction, a sheet of the minimum size discharged to the second surface of the tray has a center of gravity on the discharge side of the bent portion. Therefore, discharged sheets of the minimum size will never be stacked beyond the bent portion but will slide down toward the discharge port so as to be stacked with their rear ends aligned.

Preferably, the height of the tray from the bent portion to the discharge port in the direction of gravity may be larger than the height of sheets of the maximum load. Thus, the height from the discharge side of the second surface to the discharge port is higher than the height of the sheets of the maximum load. Therefore, even if the sheets discharged from the discharge port, especially the rear end thereof are curled upward, the curled portion will never be beyond the discharge port, so that the discharge of the succeeding sheets will never be hindered. In addition, the height of the tray from the bent portion to the discharge port in the direction of gravity may be larger than the height of sheets of the maximum load, which minimizes the apparatus.

Preferably, the tray may be formed with a recess extending from the bottom of the feed sheets or the discharge sheets to be set thereon to the outside. The recess allows the sheet to be easily taken out by inserting fingers through the recess to the bottom of the discharged sheets when resetting the sheets after sheet jam correction process or taking out the sheets.

Preferably, the apparatus may further comprise: a moving mechanism for moving the discharged sheets discharged on the second surface of the tray to the feed position on the first surface; a sensor for detecting the movement of the discharged sheets to the feed position; and a weight plate for pressing the front end of the sheet when the sensor detects the movement of the discharged sheets to the feed position. Thereby, the sheet is hold by the weight plate until the sheet is fed, which prevents the sheet from shifting.

Preferably, the apparatus may further comprise a fixed sheet-restricting plate and a movable sheet-restricting plate for restricting the movement of the sheet in a direction perpendicular to the sheet conveying direction, wherein a spacing between the fixed sheet-restricting plate end the movable sheet-restricting plate on the discharge side in the direction perpendicular to the sheet conveying direction may be wider than that on the feed side. Thus, the sheet discharged from the discharge port, even if skewed or shifted from the standard, is accommodated in wider spacing between the fixed sheet-restricting plate and the movable sheet-restricting plate. Then, as the sheet is moved from discharge to feed side, the spacing between the fixed sheet-restricting plate and movable sheet-restricting plate becomes narrower, so that the sheet is urged toward the direction perpendicular to the sheet conveyance direction so as to be aligned with the fixed sheet-restricting plate.

Preferably, a spacing between a discharge side end of the movable sheet-restricting plate and the discharge port may be smaller than the length of the minimum-size sheet in the sheet conveying direction. Thus, the sheet, even if skewed, or shifted from the standard, will never be escape out through the gap between the discharge side end of the movable sheet-restricting plate and the discharge port.

The present invention is also directed to the copying machine comprising a document conveying apparatus which feeds documents to an exposure position and discharges the document and an image forming apparatus which executes copying process of the document synchronously with the feed and discharge operation of the document conveying apparatus, the document conveying apparatus being equipped with a tray which couples feed port and discharge port to each other by a continuous surface, in which apparatus the tray comprises a first surface adjacent to the feed port for placing thereon sheets to be fed, a second surface adjacent to the discharge port for placing thereon discharged sheets, the second surface being tilted up so that the front end of the discharged sheet is positioned upper than the rear end thereof, and a bent portion at which the end of the first surface at the discharge side and the end of the second surface at the feed side are coupled to each other, wherein a length of the first surface ranging from the bent portion to the feed port in the document conveyance direction is larger than one half of the length of a feedable maximum size document in the document conveyance direction, and wherein a length of the second surface ranging from the discharge port to the bent portion in the document conveyance direction is larger than one half of the length of a feedable minimum size document in the document conveyance direction.

DETAILED DESCRIPTION OF THE PREFERRED EMBODIMENTS

Hereinbelow, embodiments of the present invention are described with reference to the accompanying drawings.

Figure 1:
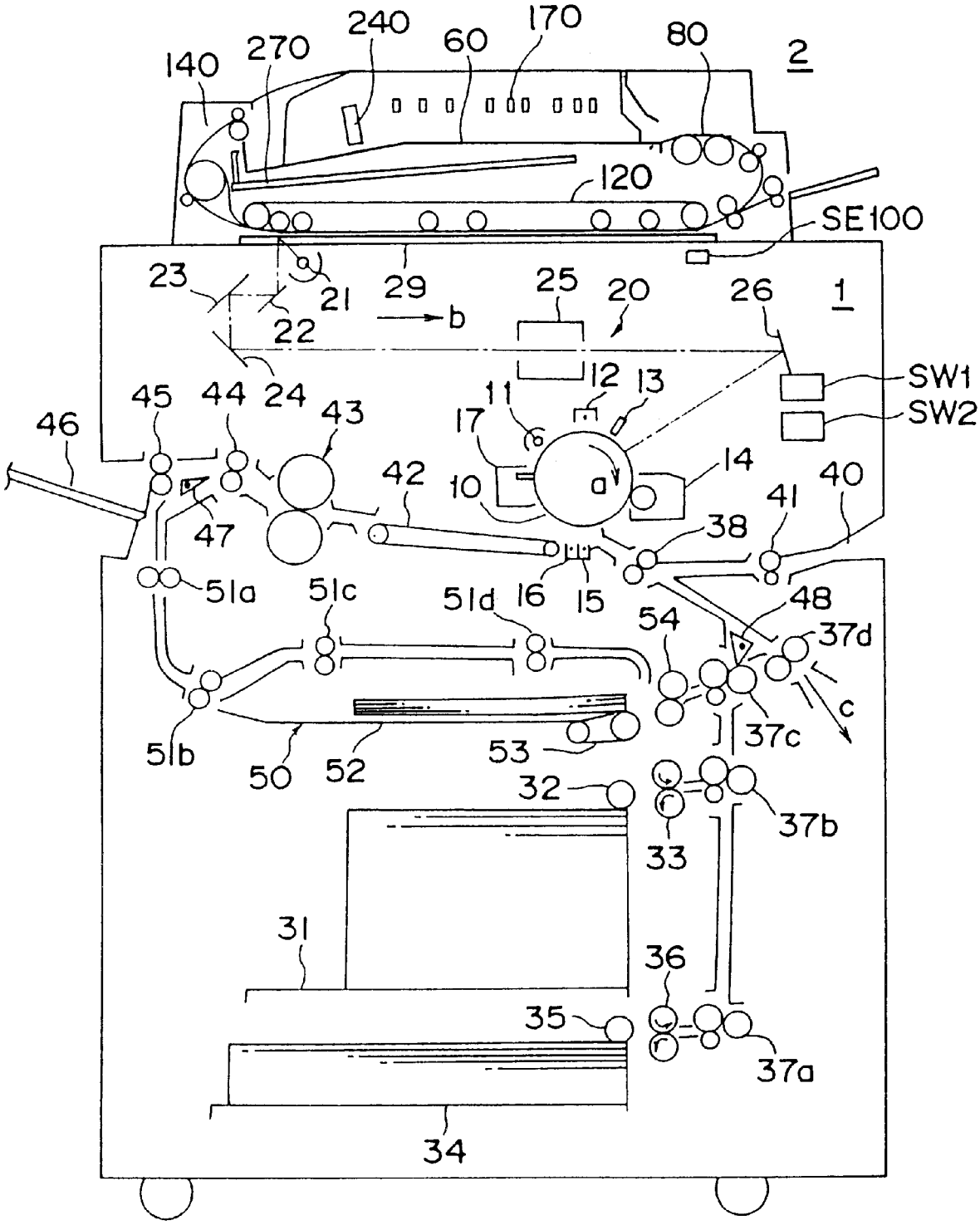
FIG. 1 is a sectional view of a copying machine equipped with a document conveying apparatus according to the present invention.

FIG. 1 shows a general construction of a copying machine. This copying machine comprises a copying machine main body 1 and an automatic document feeder (hereinafter, referred to as ADF) 2.

Construction and Operation of the Copying Machine Main Body

First, schematic construction and operation of the copying machine main body are described.

At a generally center portion of a copying machine main body generally denoted by numeral 1, a photosensitive drum 10 having a photosensitive layer on its outer circumference is installed so as to be rotatable in a direction of arrow "a" at a constant peripheral speed v. Around the photosensitive drum 10, there are provided, in its rotating direction, a main eraser 11, a corona charger 12, a sub-eraser 13, a developing unit 14 of the magnetic brush type, a transfer charger 15, a paper-separating charger 16, and a cleaner 17 of the blade type. Also, an optical system 20 is disposed above the photosensitive drum 10.

The photosensitive drum 10 rotates in the direction of arrow "a", whereupon the main eraser 11, the corona charger 12, and the sub-eraser 13 perform the processes of erasing, charging, and inter-image and end-of-image erasing, respectively, and thereafter the image of a document set on a document class 29 is exposed to light by the optical system 20. An electrostatic latent image formed on the photosensitive drum 10 by the exposure is visualized as a toner image by the developing unit 14.

The optical system 20, disposed just under the document glass 29, concurrently scans and illuminates the image of the document set with its one end coincident with an exposure reference or standard position SP, so that the photosensitive drum 10 is exposed to the resulting reflected light. During the image scanning operation, an exposure lamp 21 and a first mirror 22 move in a direction of arrow "b" at a speed v/m (m: copying magnification) with respect to the peripheral speed v (constant regardless of copying magnification) of the photosensitive drum 10. Further, at the same time, a second mirror 23 and a third mirror 24 move in the direction of arrow "b" at a speed v/2 m. Also, with a change in the copying scale factor involved, a projection lens 25 moves on the optical axis, while a fourth mirror 26 swings or rotates so that the optical length is corrected.

Copying sheets, i.e. copying paper, are accommodated in an upper-stage paper feed unit 31 of the elevator type and a lower-stage paper feed unit 34 of the tray type, and fed one by one from either one of them based on the selection by the operator. The paper feed units 31, 34 are provided with feed rollers 32, 35, and separating rollers 33, 36 each composed of a forward roller and a reverse roller. A sheet of paper fed from the upper-stage paper feed unit 31 is fed through conveyor rollers 37*b*, 37*c* to a timing roller 38 provided immediately before an image transfer unit. A sheet of paper fed from the lower-stage paper feed unit 34 is fed through conveyor rollers 37*a*, 37*b*, 37*c* to the timing roller 38.

This copying machine also allows paper feed by manual operation, in which case a sheet of copying paper inserted from a manual feed port 40 is fed through a feed roller 41 to the timing roller 38. The sheet of paper fed to the timing roller 38 temporarily stands by here until it is sent out to a transfer section when the timing roller 38 is turned on in synchronization with an image formed on the photosensitive drum 10. The sheet is brought into close contact with the photosensitive drum 10 in the transfer section, where a toner image is transferred by corona discharge from the transfer charger 15, and then the sheet is separated from the photosensitive drum 10 by the a.c. corona discharge from the paper-separating charger 16 and by the sturdiness of the sheet itself. Thereafter, the sheet is fed through a conveyor belt 42 to a fixing unit 43, where toner is fixed, and then the sheet is discharged through a conveyor roller 44 and a discharge roller 45 onto a discharge tray 46. Meanwhile, the photosensitive drum 10 continues rotating in the direction of arrow "a" even after the transfer process, under which the photosensitive drum 10 has residual toner removed therefrom by the cleaner 17 and residual charges erased by the main eraser 11, thus being ready for the next copying process.

Within the copying machine 1, there are provided a paper refeed unit 50 and paper-path switching claws 47, 48 for processing double-side or combined copy. The switching claw 47 is set normally to a solid-line position, and guides the sheet to the discharge tray 46. In the mode of double-side copy or combined copy, a sheet onto the first surface (front surface) of which the image of the document has been transferred is discharged through conveyor rollers 51*a*, 51*b*, 51*c*, 51*d* to an intermediate tray 52, by the switching claw 47 being set to a position which is slightly rotated counter-clockwise. Then the sheet is accommodated on the intermediate tray 52 with its image surface upward. After a specified number of sheets have been accommodated on the intermediate tray 52, with a refeed signal issued, the sheets are fed one by one, beginning to be fed with the lowest-layer of the sheets, by the rotation of a refeed belt 53 and a separating roller 54 to the conveyor roller 37*c*.

In the double-side copy mode, the refed sheet is fed to the timing roller 38 while being guided upward by the switching claw 48 set to a solid-line position. Then, the image is transferred onto the second surface (rear surface) of the sheet, fixed, and then discharged to the discharge tray 46. In the combined copy mode, the refed sheet is conveyed in a direction of arrow "c" by a conveyor roller 37*d* by the switching claw 48 being set to a position which is slightly rotated clockwise. Immediately before the rear end of the sheet passes a nip portion of the conveyor roller 37*d*, the conveyor roller 37*d* is switched to the reverse rotation, whereby the sheet is reversed upward down and frontward back and sent out as such to the timing roller 38. Thereafter, the image is overlappingly transferred onto the first surface (front surface), fixed, and discharged onto the discharge tray 46.

Construction and Operation of ADF 2

The construction and operation of the ADF 2 is now described in detail.

The ADF 2 generally comprises a document tray 60, a document feed section 80, a document conveying section 120, a document discharge section 140, a document restricting section 170, a document move preventing section 240, and a document refeed moving section 270.

This ADF 2 is installed on the top of the copying machine 1 so that the document conveying section 120 is positioned on the document glass, 29 of the copying machine 1. The ADF 2 is openable to the top surface of the document glass 29 by an unshown hinge fitting provided on the rear surface side.

Before the description of the individual sections of the ADF 2 proceeds, the document conveyance operation is outlined. To set the document manually onto the document glass 29, the operator lifts the ADF 2 upward to make the top surface of the document glass 29 opened. The opening of the ADF 2 is detected by a magnet sensor SE100 as shown in FIG. 1. The ADF 2 will not be operable until the magnet sensor SE100 detects that the ADF 2 is properly closed.

The document feed section 80 feeds document sheets placed on the document tray 60, beginning with the lowermost sheet, so that the sheets are separated one by one so as to be fed to the document conveying section 120. The document conveying section 120 conveys the document sheet fed from the document feed section 80 to a specified position on the document glass 29 of the copying machine 1. The document sheet scanned by the optical system 20 is discharged by the document discharge section 140. The discharged document sheet is restricted at its front end by the document restricting section 170 and placed on the document tray 60. With the document recirculation mode selected, when all the document sheets have been discharged, the sheets are moved to the document feed section 80 by the document refeed moving section 270, thus refed.

Now the individual sections of the ADF 2 are explained.

Document Tray

The document tray 60, as shown in FIG. 3, has a continuous surface that couples a feed port 61 and a discharge port 62 together at their lower portions. This continuous surface comprises a first surface 63 for placing thereon the fed document sheet extending from the feed port 61 toward the discharge port 62, and a second surface 64 for placing thereon the document sheet extending from below the discharge port 62 toward the feed port 61. The first surface 63 is provided horizontal, and the second surface 64 is tilted up toward the feed port 61 so that the front end of the discharged sheet discharged from the discharge port 62 is positioned upper than its rear end. A tilt angle a of this second surface 64 is 5 to 30E, preferably 10E. The first surface 63 and the second surface 64 are coupled to each other at a bent portion 65.

Figure 3A:
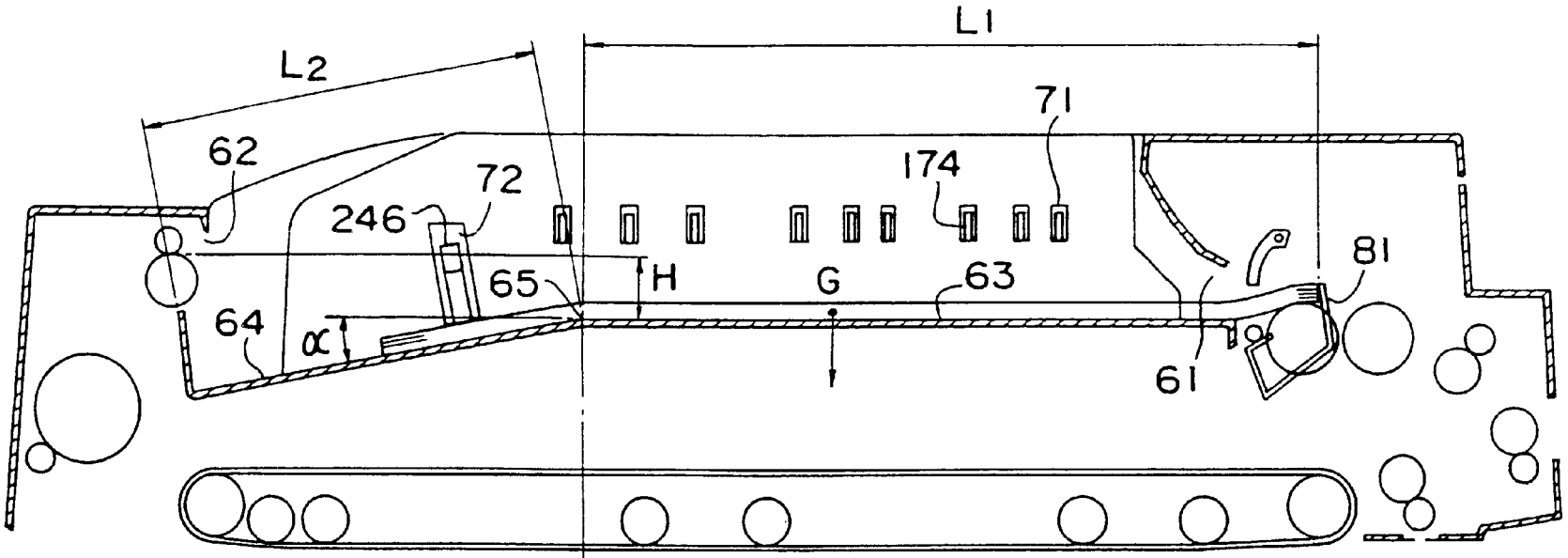
FIG. 3 is a sectional view for explaining a configuration of the document tray.

A length L1 of the first surface 63 ranging from an end restricting plate 81 of the feed port 61 to the bent portion 65 in the document feed direction is larger than one half of the length of a feedable maximum-size document sheet in the document feed direction. As a result, as shown in FIG. 3A, document sheets of not only the maximum size but also smaller sizes have a center of gravity G on the feed side of the bent portion 65. Therefore, when the document sheet is set on the first surface 63 or when the discharged document sheet is moved from the second surface 64 to the first surface 63 for refeed and reset as such, the set document sheet is prevented from slidingly moving toward the discharge port 62 or shifting toward the discharge port 62 due to vibrations of the machine during the sheet feed operation. Also, even such document sheets as the discharged sheets are overlapping on fed sheets can be prevented from misalignment of discharged sheets because the rear end side of the fed document is directed downward at a boundary of the bent portion 65 so that the front end of the discharged sheet will never contact the rear end of the fed sheet.

Figure 3B:
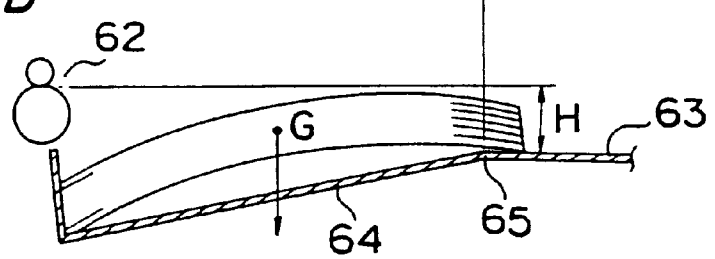

A length L2 of the second surface 64 ranging from the discharge port 62 to the bent portion 65 in the document feed direction is larger than one half of the length of a feedable minimum document sheet in the document feed direction. As a result, as shown in FIG. 3B, a document sheet of the minimum size discharged to the second surface 64 has a center gravity G on the discharge side of the bent portion 65. Therefore, discharged document sheets of the minimum size will never be stacked beyond the bent portion 65 but will slide down toward the discharge port 62 so as to be stacked with their rear ends aligned.

A height H of the document tray 60 from the bent portion 65 to the discharge port 62 in the direction of gravity is set equal to, preferably larger than, the height of document sheets of the maximum load. As a result, the height from the second surface 64 to the discharge port 62 increases over the height of the document sheets of the maximum load as it gets increasingly farther from the bent portion 65 toward the discharge port 62. Therefore, as shown in FIG. 3B, even if the document sheets discharged from the discharge port 62 are curled upward in placement on the second surface 64, the top surface of the document sheets will never be beyond the discharge port 62, so that the discharge of the succeeding document sheets will never be hindered.

Figure 4:
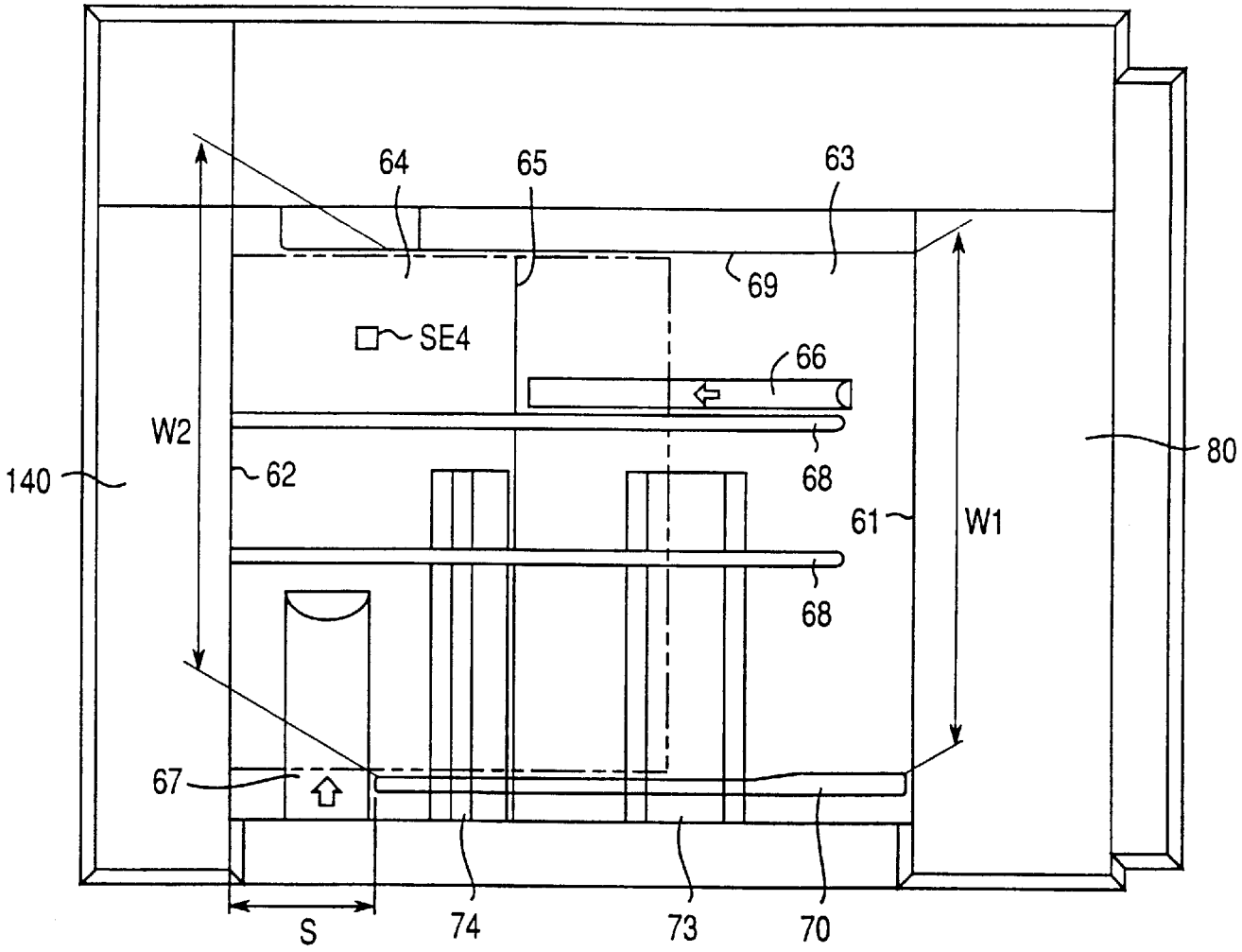
FIG. 4 is a plan view for explaining a planar configuration of the document tray.

As shown in FIG. 4, a first recess 66 extending in the document feed direction is formed in the first surface 63 of the document tray 60, and a second recess 67 extending in a direction perpendicular to the feed direction is formed in the second surface 64. These first recesses 66, 67 allow document sheets placed on the document tray 60 to be taken out simply and without damaging the document sheets by inserting fingers to the bottom of the discharged document sheets in the direction indicated by arrow.

Two grooves 68 for allowing a refeed lever 274 of the document refeed moving section 270, which will be described later, to be moved in the document feed direction are formed so as to stretch from the second surface 64 to the first surface 63. Reference numerals 73 and 74 denote guide grooves for a movable document-restricting plate 70. A fixed document-restricting plate 69 which serves as a one-side standard for document conveyance is provided at a rear-side end portion of the document tray 60, and the movable document-restricting plate 70 is provided at a front-side end portion of the document tray 60 so as to be movable in a direction perpendicular to the document feed direction. In the fixed document-restricting plate 69, as shown in FIG. 3, there are provided, in array and in the document feed direction, a plurality of openings 71 where a later-described discharged-document stopper 174 of the document restricting section 170 appears and disappears, and one opening 72 where a later-described document-pressing ever 246 appears and disappears.

The movable document-restricting plate 70, as shown in FIG. 4, is provided thicker, or tilted, on the feed side than on the discharge side in a document feed direction, the thickness or tilt being directed toward the fixed document-restricting plate 69 on the standard side. As a result, a spacing W2 between the fixed document-restricting plate 69 and the movable document-restricting plate 70 on the discharge side in a direction perpendicular to the document feed direction is wider than a spacing W1 on the feed side. Therefore, the document sheet discharged from the discharge port 62, even if skewed or shifted from the standard, is accommodated in wider spacing W2 between the fixed document-restricting plate 69 and the movable document-restricting plate 70. Then, as the document sheet is moved from discharge to feed side, the spacing between the fixed document-restricting plate 69 and movable document-restricting plate 70 becomes narrower, so that the document sheet is urged toward the direction perpendicular to the document feed direction so as to be aligned with the fixed document-restricting plate 69.

A spacing S is provided between a discharge side end of the movable document-restricting plate 70 and the discharge port 62. This allows the discharged document sheet to be taken out by inserting hand into this spacing S. Because the spacing S is formed smaller than the length of the minimum-size document sheet in the feed direction, the document sheet, even if skewed, or shifted from the standard, will never be escape out through the gap between the discharge side end of the movable document-restricting plate 70 and the discharge port 62.

Figure 5A:
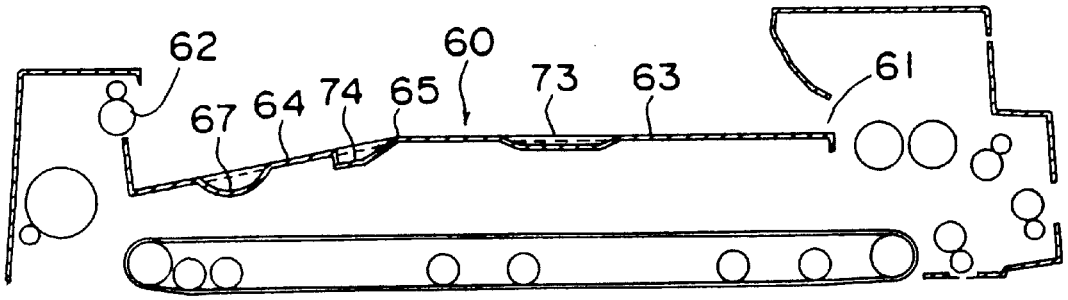
FIG. 5 is a sectional view for explaining another configuration of the document tray.
Figure 5B:
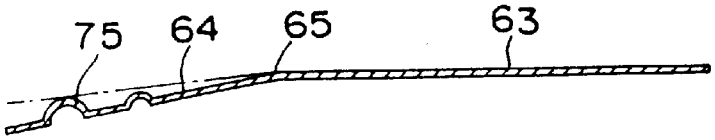
Figure 5C:
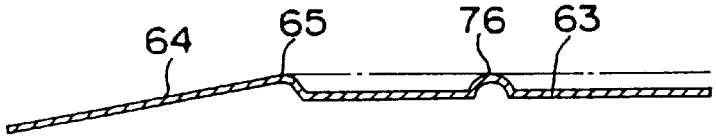
Figure 5D:
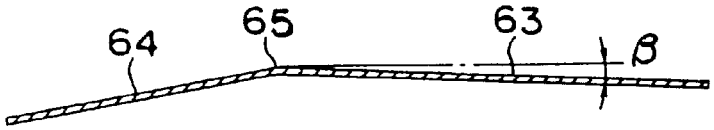

In addition, the first surface 63 and the second surface 64 of the document tray do not necessarily need to be flat, and the recess 67 for taking out the document sheet or the guide grooves 73, 74 and the like as described above may be formed therein as shown in FIG. 5A. Also, when a projection 75 is formed in the second surface 64 as shown in FIG. 5B, there is no problem only if the line interconnecting the vertex of the projection 75 and the bent portion 65 is tilted. Likewise, a projection 76 may be formed also in the first surface 63 as shown in FIG. 5C. The first surface 63 does not necessarily need to be horizontal, and may be tilted βE downward from the bent portion 65 toward the feed port 61 as shown in 5D.

Document Feed Section

Figure 2:
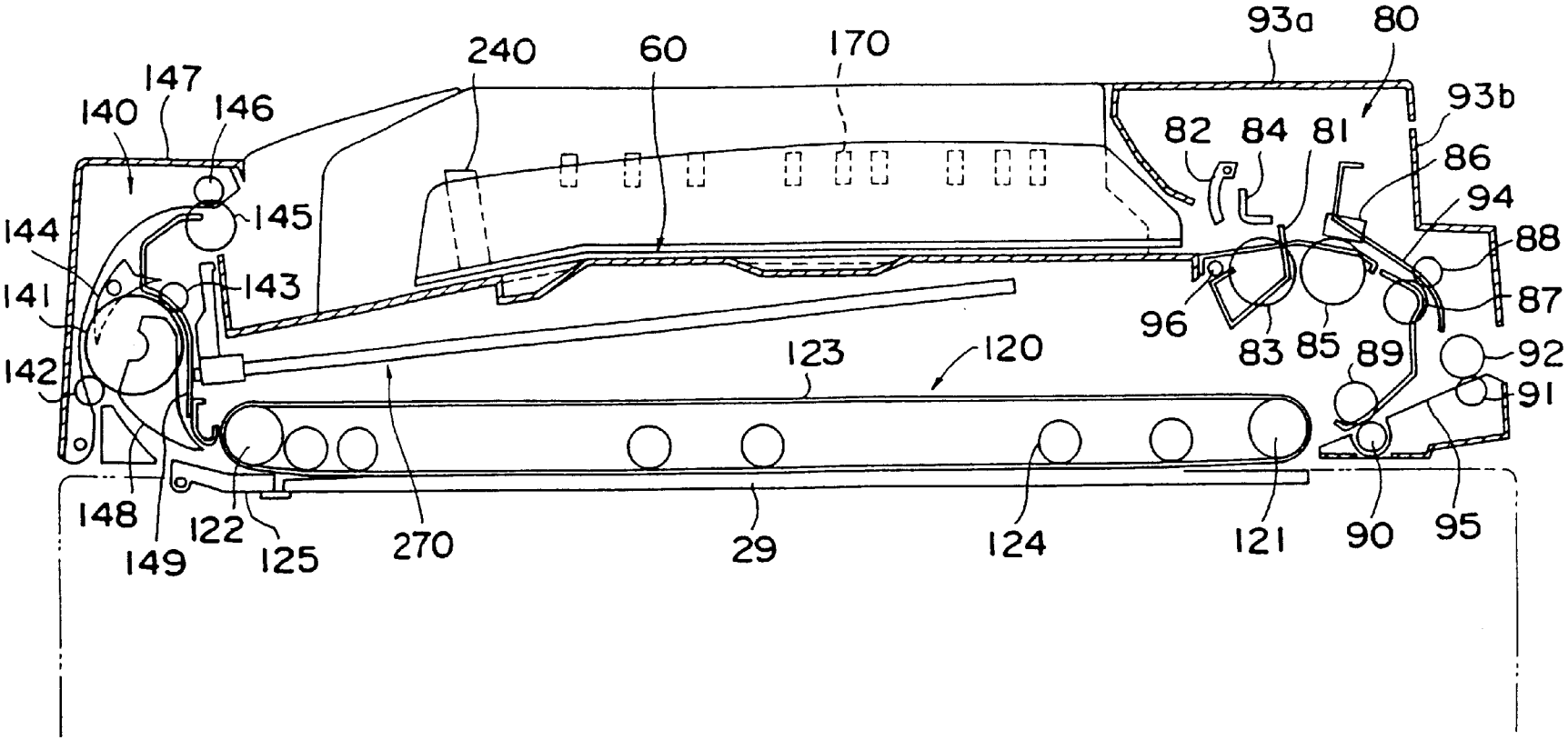
FIG. 2 is a sectional view of the document conveying apparatus according to the present invention.

The document feed section, as shown in FIG. 2, comprises an end restricting plate 81, a refeed preventing member 82, pickup rollers 83 as well as document pressing plates 84 contactable under pressure therewith, a separating roller 85 as well as a separating pad 86 making press contact therewith, an intermediate conveyor roller 87 as well as a pinch roller 88 making press contact therewith, a register roller 89 as well as a pinch roller 90 making press contact therewith, and a document feed roller 91 as well as a pinch roller 92 making press contact therewith, all of these members being covered with a fixed cover 93*a* and an openable/closable cover 93*b*. Along the pickup roller 83, the separating roller 85, the intermediate conveyor roller 87 and the register roller 89, are provided guides 94, by which a sheet path is formed. Also, by a guide 95 placed along the manual-feed document feed roller 91 and the register roller 89, a manual-feed sheet phase is formed.

The end restricting plate 81 is provided rotatable about a pivot shaft 96, where an end of the end restricting plate 81 is appearable to and disappearable from the sheet path on somewhat downstream side of the pickup roller 83. The end restricting plate 81 restricts the end of the document sheet set on the document tray 60. The end restricting plate 81 withdraws downward from when the first document sheet is fed until when the final document sheet is fed.

Figure 6:
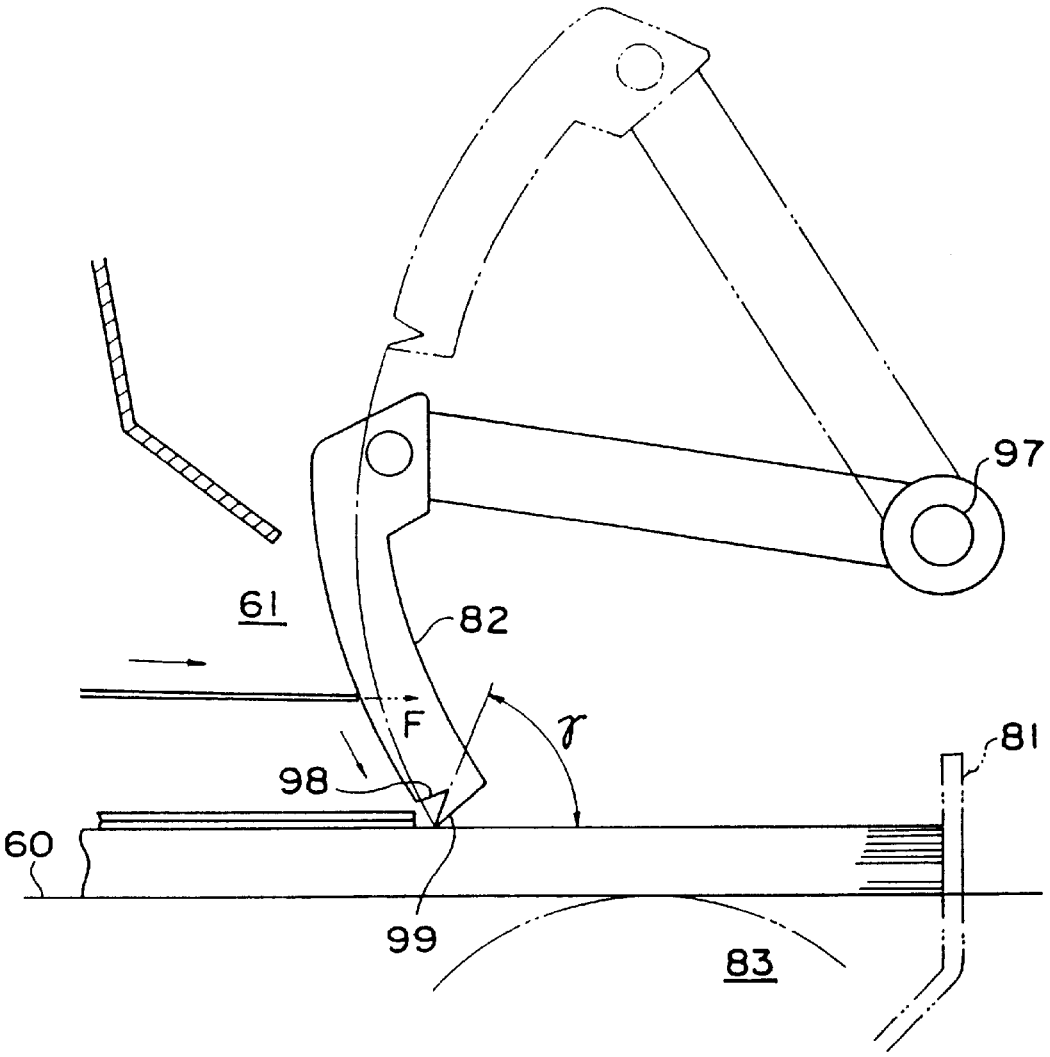
FIG. 6 is an enlarged view of the refeed preventing member.

The refeed preventing member 82, which comprises a generally L-shaped lever as shown in FIG. 6, is provided pivotable about a pivot 97 between an operative position where it presses the top surface of the fed document sheet and a withdrawal position above the operative position. The position of the pivot 97 serving as a fulcrum for the refeed preventing member 82 is so set that a force F with which the end of the discharged sheet rushing into the feed port 61 strikes against the refeed preventing member 82 does not cause the refeed preventing member 82 to be withdrawn upward. Also, the outer edge of the refeed preventing member 82 is formed into such an arc shape having an upward tilt from the upstream side of the document feed direction that when the refeed preventing member 82 is in the operative position, the discharged sheet that has struck against the outer edge of the refeed preventing member 82 is guided to the top surface of the fed sheet below.

At an end of the refeed preventing member 82, a claw portion 99 is provided by forming a V-shaped cutout 98. The withdrawal path of the end of this claw portion 99 about the pivot shaft 97 is inside the outer edge configuration of the refeed preventing member 82 as indicated by one-dot chain line in FIG. 6. The angle γ of the upper edge of the claw portion 99 of the refeed preventing member 82 with respect to the fed document sheet in the feed direction is not more than 90E, preferably 80E.

When the document sheet is set on the document tray 60, the refeed preventing member 82 is positioned in the withdrawal position above. As the document sheets start to be fed, the refeed preventing member 82 pivots to the operative position with the claw portion 99 of its end in contact with the top surface of the fed document sheet. The lowermost sheet of the fed document sheets is fed, copying processed, and discharged from the discharge port 62. Then the discharged sheet is placed on the document tray 60.

With the document size large, the end of the discharged sheet may enter into the feed port 61 as shown in FIG. 6. In this case, the end of the discharged sheet strike against the outer edge of the refeed preventing member 82 and guided downward so as to be placed on the fed document sheets.

Even if the end of the discharged sheet has struck against the outer edge of the refeed preventing member 82 so that the force F acts thereon, the refeed preventing member 82 does not withdraw upward. Therefore, the discharged sheet will never evade the refeed preventing member 82 as the feeding of fed sheets goes on, so that the refeed is reliably prevented. When the last fed document sheet which makes contact with the claw portion 99 of the end of the refeed preventing member 82 is fed, the angle γ of the claw portion 99 of the refeed preventing member 82 is not more than 90E as described above, thus more preferable in that the discharged sheet is unlikely to evade the claw portion 99.

Figure 7:
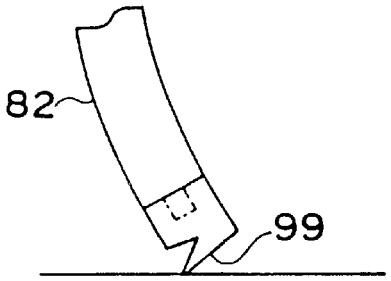
FIG. 7 is a partly enlarged view of another embodiment of the refeed preventing member.

When all the fed document sheets have been fed completely, the refeed preventing member 82 pivots to the withdrawal position above. In this operation, the claw portion 99 of the refeed preventing member 82 withdraws without getting caught in the discharged document sheet, the discharged sheet is not damaged at its rear end. In addition, in order to positively prevent damage of the top surface of feed sheets and the front end of discharged sheets, the claw portion 99 of the refeed preventing member 82 may the made of elastic material, preferably rubber material, and fitted to the tip end of the refeed preventing member 82 as shown in FIG. 7.

Figure 8:
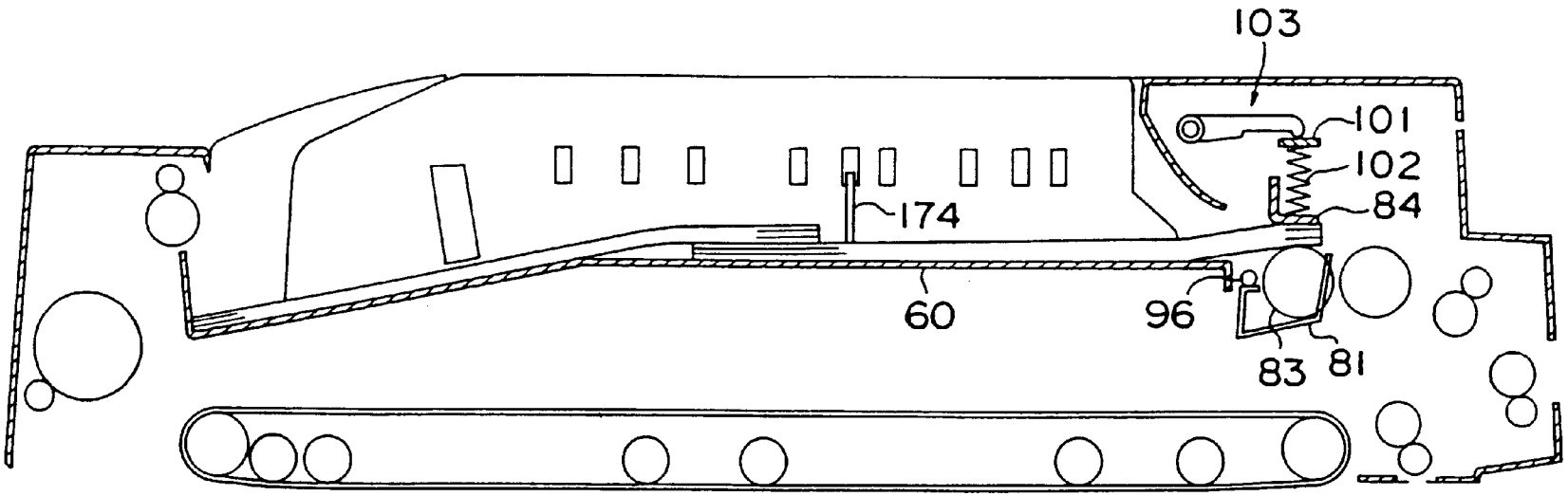
FIG. 8 is a sectional view for explaining the document presser plate.

The pickup roller 83 is provided rotatable clockwise in FIG. 8. This pickup roller 83 is provided three in combination in a direction perpendicular to the document feed direction as shown in FIG. 9.

The document pressing plates 84 are placed above the three pickup rollers 83 so as to be opposed thereto, and can be moved up and down to a pressing position and a withdrawal position above by a lever 100. Above the document pressing plates 84, an elongate spring support plate 101 is provided axially of the pickup rollers 83. Between this spring support plate 101 and each document pressing plate 84, two coil springs 102 are interveniently provided so that a sheet feed pressure is imparted to the fed sheets placed on the pickup rollers 83 by these coil springs 102. The sheet feed pressure to the fed sheets can be varied by a later-described sheet-feed-pressure variable mechanism 103.

Figure 9:
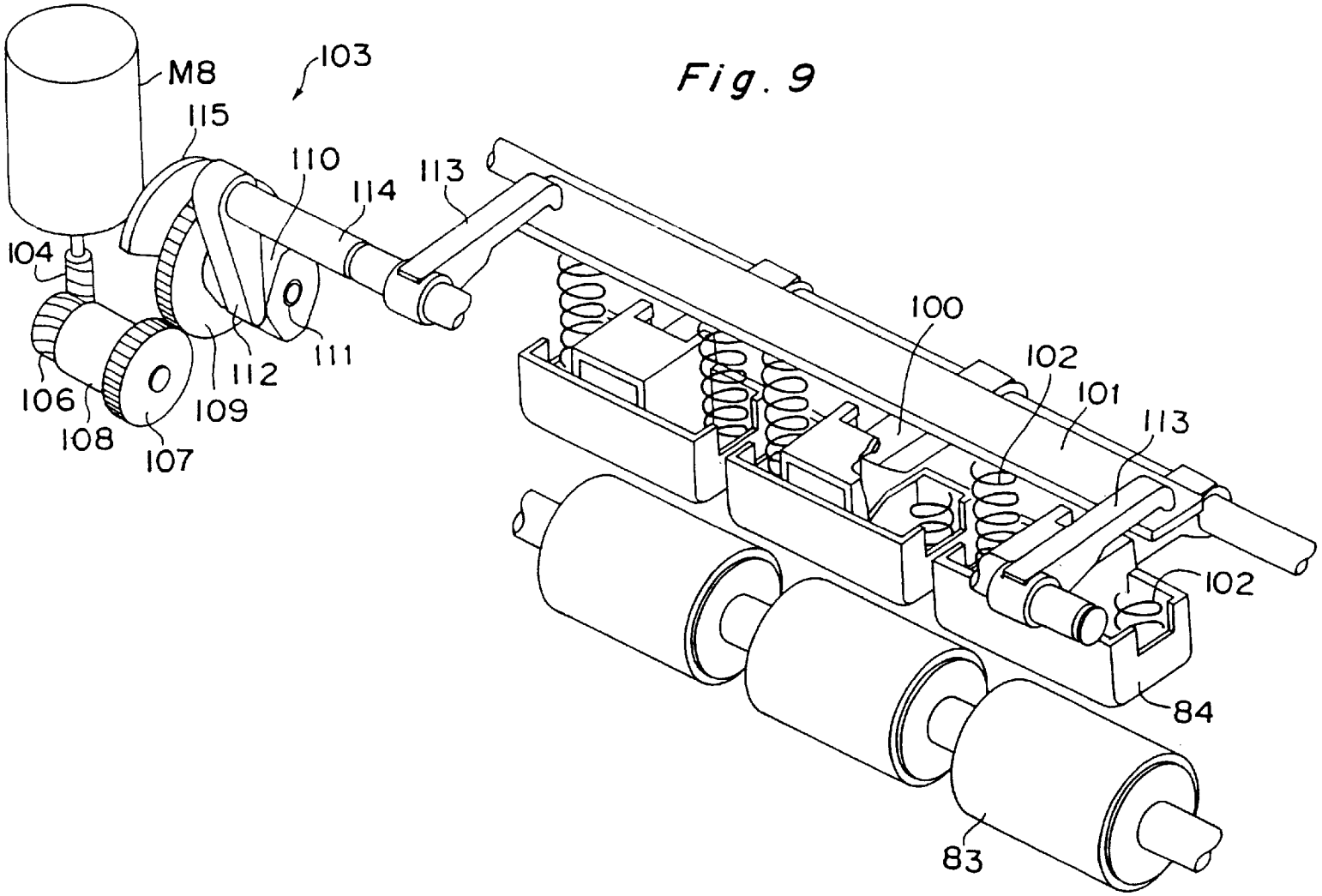
FIG. 9 is a perspective view of the paper-feed pressure variable mechanism.

The sheet-feed-pressure variable mechanism 103, as shown in FIG. 9, comprises a sheet-feed-pressure variable motor M8 with a worm 104 fitted to its drive shaft, a transmission shaft 108 equipped with a worm wheel gear 106 and a gear 107 which are screwed to the worm 104 of the sheet-feed-pressure variable motor M8, a cam shaft 111 equipped with a gear 109 and a cam 110 which are screwed to the gear 107 of the transmission shaft 108, and a lever shaft 114 equipped with a drive lever 112 which contacts the cam 110 of the cam shaft 111 and a presser lever 113 which contacts the spring support plate 101. A detector plate 115 of a cutout circular shape is fitted to the cam shaft 111 so that the position of the cam 110 can be detected by an unshown sensor.

Figure 10A:
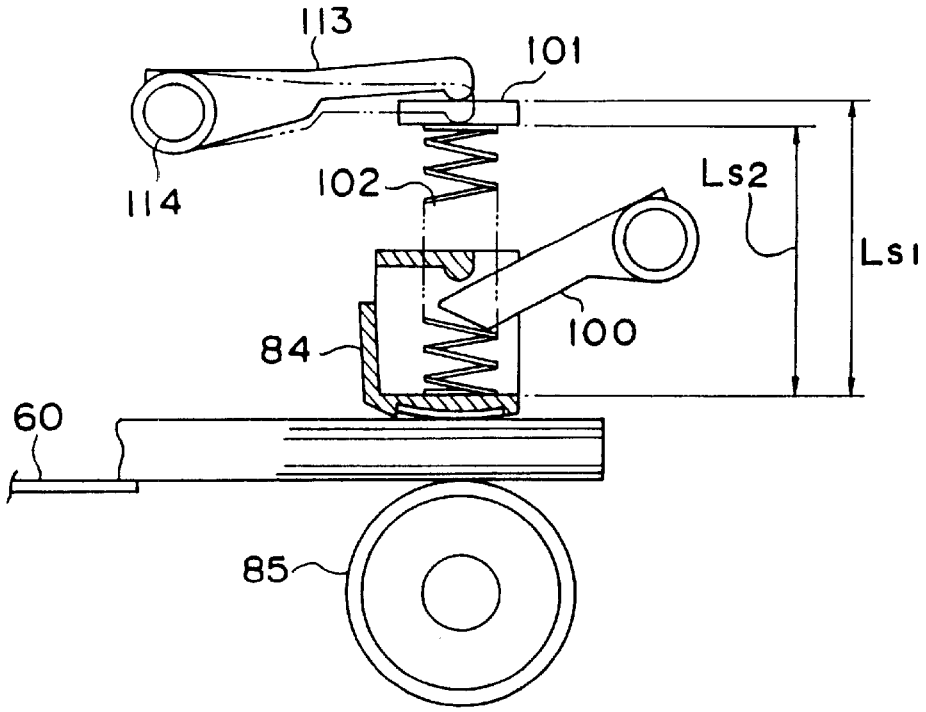
FIGS. 10A and 10B are partly enlarged views of the paper-feed pressure variable mechanism in one state that the paper-feed pressure is imparted and another that the mechanism is retreated, respectively.
Figure 10B:
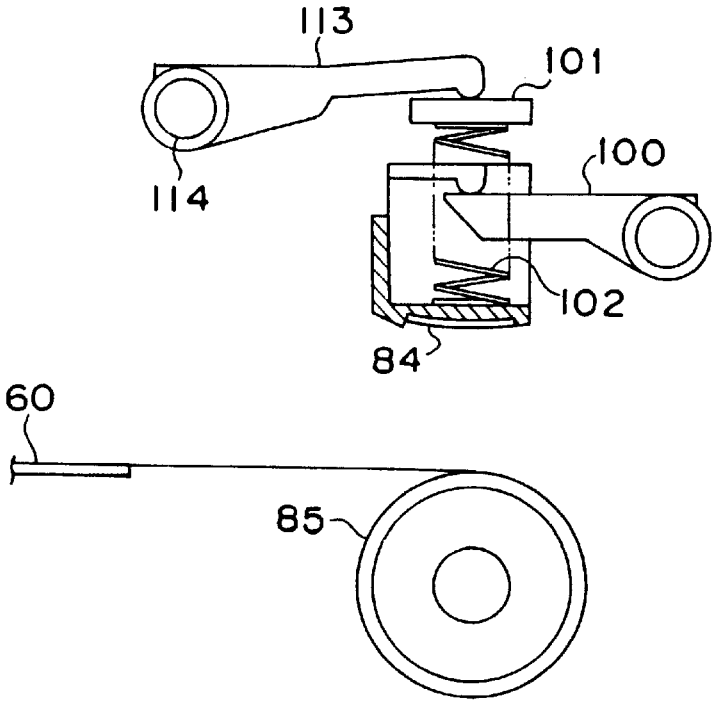

When the document is set on the document tray 60, the document pressing plate 84 is located in the withdrawal position by the lever 10D pivoting upward against the urging force of the coil springs 102 as shown in FIG. 10B. With the document set as shown in FIG. 10A, when the first fed document sheet is fed, the lever 100 pivots downward so that the document pressing plate 84 moves to the lower pressing position, where a sheet feed pressure is imparted to the top surface of the fed document sheet by the urging force of the coil springs 102. As a result, the fed document sheets are sent out one by one, starting with the lowermost one.

As the fed document sheets are fed one by one with their height decreased, the coil springs 102 expands so that the sheet feed pressure decreases. For this reason, when the height of the fed document sheets has decreased to more than a certain level, the sheet feed pressure may become insufficient. Also, when the document sheets are of such a size that the sheets are discharged with overlaps one on another as shown in FIG. 8, not only the height of the fed document sheets decreases so that the sheet feed pressure decreases, but also the weight of the discharged document sheet is applied to the rear end of the fed document sheet, with the result that the sheet feed pressure would become further insufficient.

Thus, in the case where insufficiencies in the sheet feed pressure of the fed document sheets are worried like this, the sheet feed pressure is increased by the sheet-feed-pressure variable mechanism 103. Two ways are available to attain this purpose. The first way is to count the number of fed document sheets previously and to increase the sheet feed pressure as shown in Table 1 when a specified number of document sheets have been fed. The second way is to detect the height of fed document sheets previously and to increase the sheet feed pressure as shown in Table 2 when the decrement of the height due to the feeding comes to over a specified value.

TABLE 1

| Document size | Sheet count |
|---|---|
| B4/legal | 20th |
| A3/W letter | 15th |

TABLE 2

| Document size | Decrement of height |
|---|---|
| B4/legal | 3 mm |
| A3/W letter | 2 mm |

In order to increase the sheet feed pressure for fed document sheets, the sheet-feed-pressure variable motor M8 of the sheet-feed-pressure variable mechanism 103 as shown in FIG. 9 is driven to a specified extent. This causes the transmission shaft 108 and the cam shaft 111 to be rotated, by which the drive lever 112 is pressed by the cam 110 of the cam shaft 111 so that the lever shaft 114 rotates. As a result, the presser lever 113 pivots, pressing the spring support plate 101. This causes the spring support plate 101 to move downward to a specified extent, so that the coil springs 102 changes in length so as to be shortened from Ls1 to Ls2, as shown in FIG. 10A. As a result of this, the urging force of the coil springs 102 increases so that the pressure between the pickup rollers 83 and the fed document sheet (sheet feed pressure) increases. This constitution eliminates the possibility of decreases in the sheet feed pressure due to the expansion of the coil springs with increase in the discharged document sheets which occurs with a constitution of non-variable sheet feed pressure, as well as the possibility of slippage of fed document sheets at the pickup rollers 83 due to the increase in pressing force of fed document sheets and discharged document sheets at the rear end of the fed document sheets, so that the frictional force between the feed rollers and the fed document sheets becomes greater than the frictional force between the rear end of the fed document sheets and the document tray.

Figure 11:
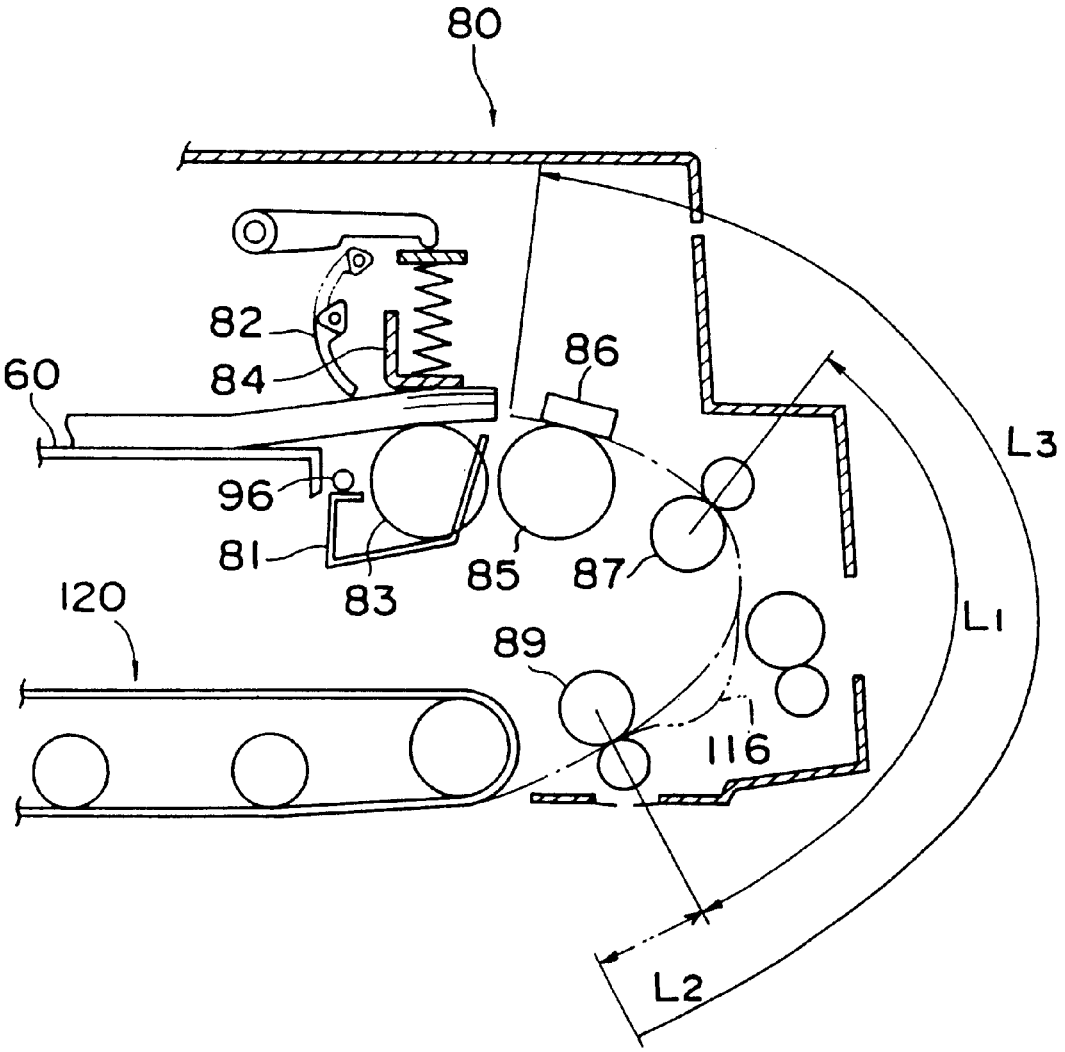
FIG. 11 is a sectional view for explaining the operation of the intermediate conveyance roller and the registration roller.
Figure 12:
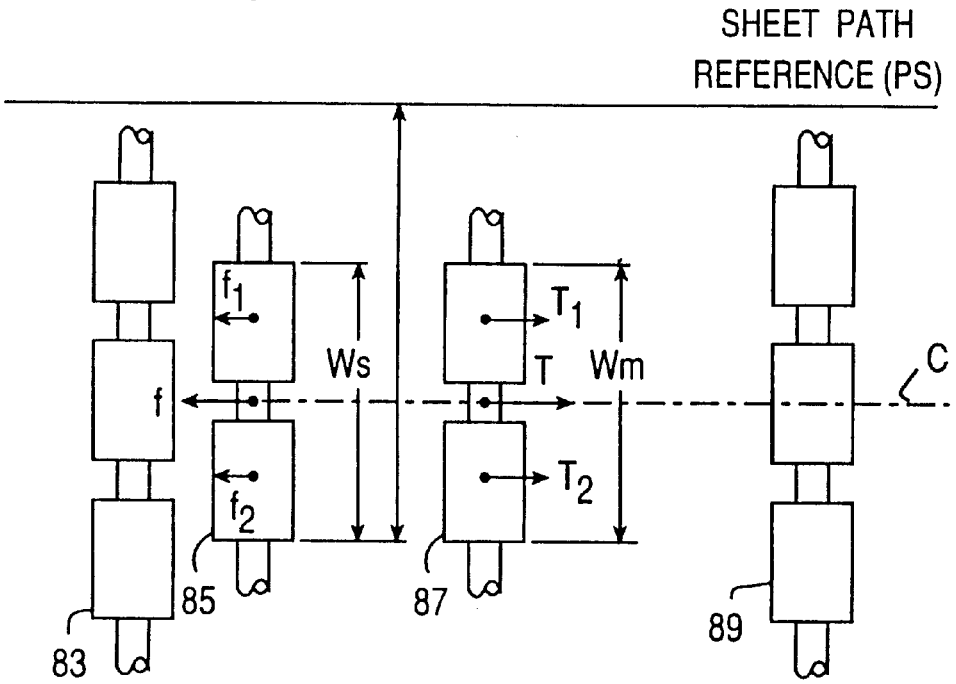
FIG. 12 is a view for explaining the arrangement of the separation roller, the intermediate conveyance roller and the registration roller.

The separating roller 85 is provided rotatable clockwise in FIG. 11. This separating roller 85 is provided two in combination in a direction perpendicular to the document feed direction as shown in FIG. 12. The separating pad 86 is so placed as to make press contact with the two separating rollers 85 generally from above, and separates the fed document sheets; sent out from the pickup rollers 83 one by one for their conveyance. In addition, instead of the combination of the separating rollers 85 and the separating pad 86, known torque limitter type separating means or reverse separating means may also be used.

The intermediate conveyor roller 87 is placed midway of the sheet path between the separating rollers 85 and a later-described register roller 89, and provided rotatable clockwise in FIG. 11. This intermediate conveyor roller 87 is provided two in combination in a direction perpendicular to the document feed direction as shown in FIG. 12.

The register roller 89 is provided just before the document conveying section 120, and rotatable clockwise in FIG. 11. This register roller 89 is provided three in combination in a direction perpendicular to the document feed direction as shown in FIG. 12.

The document conveyance speed of the intermediate conveyor rollers 87 is faster than that of the separating rollers 85, and the document conveyance speed of the register rollers 89 is set faster than that of the intermediate conveyor rollers 87. Document sheets separated one by one by the separating rollers 85 are conveyed by the intermediate conveyor rollers 87, fitting to nip portions of the register rollers 89. At this time point, the register rollers 89 are at rest, whereas the separating rollers 85 and the intermediate conveyor rollers 87 will be driven for a certain time until they are stopped. As a result, the fed document sheet has a loop portion 116 formed between the intermediate conveyor rollers 87 and the register rollers 89 as indicated by two-dot chain line in FIG. 11. Then, in a certain time elapse since this state, the intermediate conveyor rollers 87 and the register rollers 89 are driven at the same time so that the document sheet is conveyed to the inlet of the document conveying section 120.

Now the placement relation between the separating rollers 85, the intermediate conveyor rollers 87 and the register rollers 83 is explained. As shown in FIG. 12, an outermost profile width, i.e., end-to-end spacing Wm of the two intermediate conveyor rollers 87 is smaller than an outermost profile width, i.e., end-to-end spacing Ws of the two separating rollers 85. A line of action of a resultant force f of frictional forces f1, f2 that occur at the two separating rollers 85, and a line of action of a resultant force T of conveying forces T1, T2 that occur at the two intermediate conveyor rollers 87 are on a line along the sheet path. Besides, the separating rollers 85, the intermediate conveyor rollers 87 and the register rollers 89 are arranged each symmetrical with respect to a line C parallel to the sheet path direction. By such an arrangement, the document sheets, when conveyed from the separating rollers 85 to the intermediate conveyor rollers 87, undergo no occurrence of any couple of forces and are therefore prevented from being fed askew. Further, the intermediate conveyor rollers 87 have an effect of reducing the time of conveyance from the separating rollers 85 to the register rollers 89, so that the productivity of sheet conveyance is enhanced.

Figure 13:
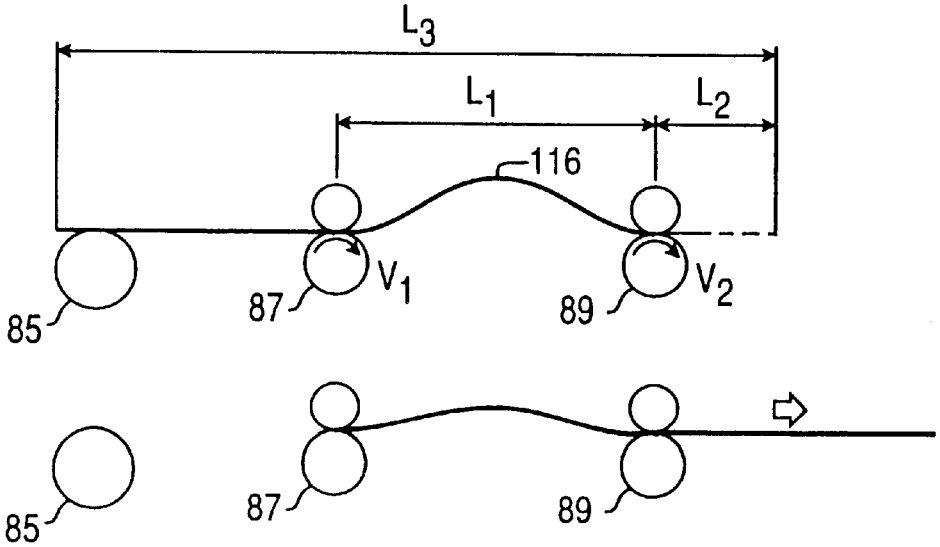
FIG. 13 is a view for explaining the operation of the intermediate conveyance roller and the registration roller.

Also, if the shortest sheet path length from the intermediate conveyor rollers 87 to the register rollers 89 is L1, the difference between the length of the document sheet conveyed by the intermediate conveyor rollers 87 and the shortest sheet path length L1, i.e., the length of the loop portion 116 of the document sheet conveyed by the intermediate conveyor rollers 87 for a certain time since the end of the document sheet is fitted to the nip portion of the register rollers 89 (in FIG. 13, the length of the loop portion 116 is extended downstream of the register rollers 89 for convenience of description) is L2, the length of a sheet in its feed direction of longest sheet size and minimum sheet width from the sheet path reference to the outermost profile is L3, and if the speed of the intermediate conveyor rollers 87 is V1 and the speed of the register rollers 89 is V2 as shown in FIG. 13, then the following relationship holds:

$$(L3-L1-L2)/V1 \leq L2/(V2-V1) \qquad \text{Equation 1}$$

By this relationship, when the intermediate conveyor rollers 87 and the register rollers 89 are driven after the formation of the loop portion 116, the loop portion 116 decreases due to the speed difference between the two sets of rollers, whereas the loop portion 116 will remain until the rear end of the document sheet passes through intermediate conveyor rollers 87. Therefore, even if the document sheet, after passing the separating rollers 85 and the intermediate conveyor rollers 87, has been put into the skewed feed state, that state is solved by the loop portion 116 so that the document sheet is conveyed in a correct state from the register rollers 89.

Besides, the width of one intermediate conveyor roller 87 is set smaller than the width of a separating roller 85 in its upstream, and located inside the width of the separating rollers 85. Therefore, because the sheets loosened and separated by the two separating rollers 85 are conveyed by the intermediate conveyor rollers 87 located downstream thereof, the sheets are less affected, for example, by the frictional force f1 of the separating rollers 85 and the conveying force T1 of the intermediate conveyor rollers 87. Thus, occurrence of sheet wrinkles is prevented.

Also, the length from the path standard to the most distant, outermost profile end of the separating rollers 85 is set shorter than the width of the permissible minimum sheet size (shorter side of A5 sheet). As a result, all the permissible sizes of sheets are prevented from being fed askew.

Document Conveying Section

The document conveying section 120, as shown in FIG. 2, comprises a drive roller 121 placed near the document feed section 80, a driven roller 122 placed near the document discharge section 140, and an endless conveyor belt 123 stretched between the drive roller 121 and the driven roller 122, all of these members being covered with the document tray 60. The conveyor belt 123 is so sized as to cover the entire surface of the document glass 29. Inside the conveyor belt 123, a multiplicity of backup rollers 124 are rotatably installed for putting the conveyor belt 123 into press contact with the document glass 29.

The conveyor belt 123 is driven to rotate clockwise in FIG. 2, conveys the document on the document glass 29, and stops the document when the front end of the document sheet meets a scale 125 which is provided in the copying machine 1 close to an end of the document glass 29.

The scale 125 has both a function of stopping the front end of the document sheet conveyed up on the document glass 29 at the exposure standard position and a function of giving an instruction for manual placement of the document on the document glass 29 by lifting the ADF 2 so that the front end of the document sheets becomes coincident with the exposure standard position.

Figure 14A:
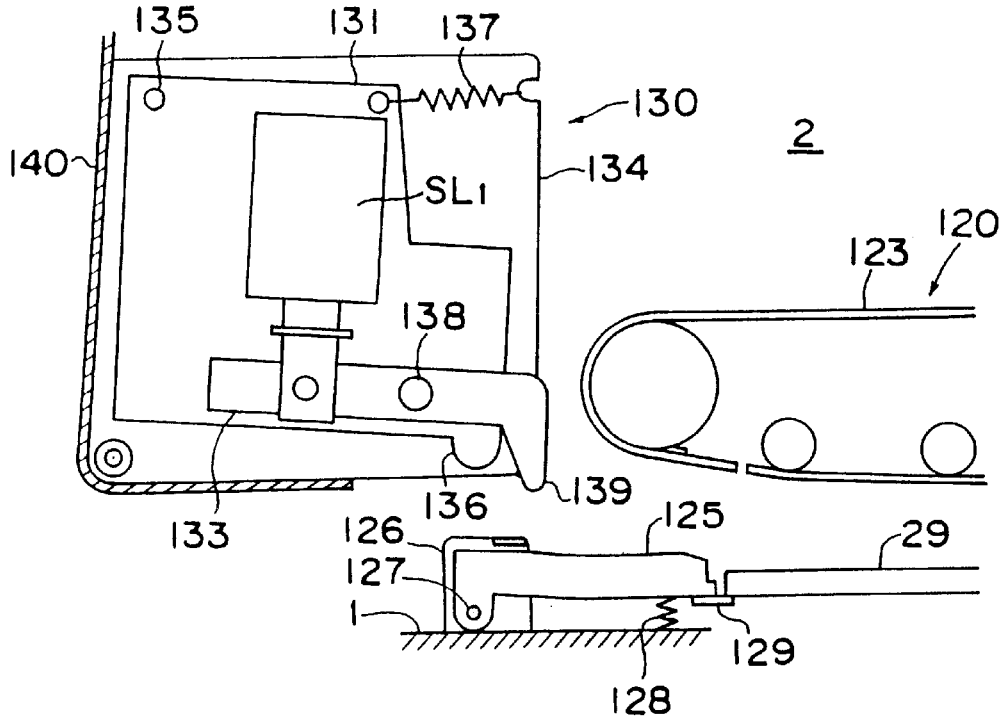
FIGS. 14A and 14B are sectional views showing the operation of the scale presser mechanism in one state that an ADF2 is up and another that the ADF2 is mounted.

This scale 125, as shown in FIG. 14A, is fitted to a holder 126 provided on both deep and fore sides of the upper frame of the copying machine main body 1, the scale 125 being pivotable on a pin 127 serving as a fulcrum and the front end of the scale 125 being urged upward by a spring 128. The scale 125 has, at the lower surface of its one end, a protrusion 129 to engage with the lower surface of the document glass 29. As a result of this, the upper surface of the end of the scale 125 is protruded to a specified height over the document glass 29. Moreover, this scale 125 is withdrawn from the top surface of the document glass 29 to below by a scale pressing mechanism 130.

The scale pressing mechanism 130 comprises a movable base plate 131, a scale solenoid SL1 and a lever 133. The movable base plate 131 is a generally rectangular plate, and one corner portion of its opposed two corner portions is fitted to an inside frame 134 of the document discharge section 140 so as to be vertically pivotable about a pivot 135 while the other corner portion has a restricting projection 136 formed opposed to the upper end of the holder 126 of the scale 125. This movable base plate 131 is urged in such a direction that the restricting projection 136 is directed toward the holder 126 of the scale 125 by a spring 137. The scale solenoid SL1 is fitted to the movable base plate 131 so that the plunger is directed downward. The lever 133 is fitted to the movable base plate 131 so as to be pivotable on a pivot 138, with one end of the lever 133 coupled to the plunger of the scale solenoid SL1 and with a protrusion 139 for pressing the scale 125 formed at the other end.

Figure 14B:
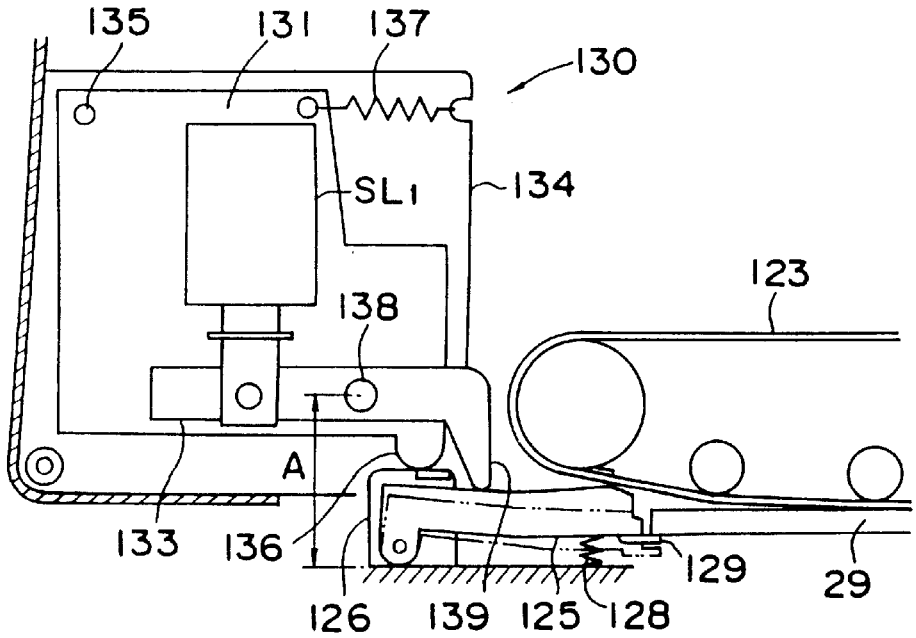

In this scale pressing mechanism 130, the scale solenoid SL1 is normally kept off with its plunger protruded downward and the lever 133 out of press against the lever 133. Upon completion of a scanning operation on the document sheet that has been stopped at the exposure standard position on the document glass 29, the scale solenoid SL1 is switched from off to on state, by which the lever 133 pivots clockwise in the figure so that its protrusion 139 presses the scale 125. In this state, the spring 137 is urged with such a force that the movable base plate 131 will not be pivoted by the urging force of the spring 128 of the scale 125, the force also being weaker than the force with which the lever 133 causes the scale 125 to be further pressed down by the scale solenoid SL1 when the scale 125 has reached the withdrawal position. With this arrangement, the lever 133 and the scale 125 are prevented from breaking. As a result of this, as indicated by two-dot chain line in FIG. 14B, the scale 125 is pressed downward against the urging force of the spring 128 so that the upper surface of the front end of the scale 125 withdraws downward from the top surface of the document glass 29. Thus, the document sheet on the document glass 29 is conveyed to the document discharge section 140 by movement of the conveyor belt 123.

Conventionally, the scale pressing mechanism is fitted to the ADF while the scale is fitted to the copying machine main body. Accordingly, in the conventional copying machine, it has been often the case that the pressing force for the scale lessens depending on variations in the fitting of the scale pressing mechanism to the ADF, especially its fitting precision at hinge portions of the ADF, such that the scale could not be withdrawn with reliability. However, in the scale pressing mechanism 130 of the present invention, even with variations in the fitting positional precision of the scale pressing mechanism 130 to the ADF 2 or in the fitting precision of the ADF 2 to the copying machine main body 1, setting the ADF 2 to the document glass 29 causes the restricting projection 136 of the movable base plate 131 to contact the upper end of the holder 126 of the scale 125 so that the movable base plate 131 pivots, by which the size A ranging from the pivot 138 of the lever 133 of the scale pressing mechanism 130 to the upper end of the holder 126 of the scale 125 is restricted to a constant value. As a result of this, a contact pressing amount for the scale 125 is ensured, making it possible to withdraw the scale 125 with reliability. Besides, such an arrangement enables the scale solenoid SL1 to be adjustment-free while the scale solenoid SL1 itself is not required to allow for torque corresponding to the variations so that the required amount of force is reduced, allowing a downsizing.

Now the document replacement in the document conveying section 120 is explained. In the document conveying section 120, subsequent to a completion of the scan on the document sheet conveyed to the exposure standard position, a document replacement is performed. A document sheet completely scanned is conveyed to the document discharge section 140, and a succeeding document sheet is conveyed to the exposure standard position. For enhanced productivity of copying process of the copying machine, the document replacement is started simultaneously with the completion of the scan of a document sheet, where the scanner starts to return after once braked.

For high-speed machines, there is a demand for speed enhancement in all of document replacement, scan and return processes, which would inevitably involve increases in current consumption for the driving of motor. The scanner varies in the time required for braking depending on the copying scale factor and, as a result, varies in the timing for the start of return, such that the respective peaks of current consumption of the ADF 2 and the scanner may overlap with each other. Resultantly, the current consumption may go beyond the specified, causing an excess of the power supply capacity such that the power supply may fall down during use. Indeed the power supply capacity can be increased to cope with such a fault, but it would result in a cost increase.

Thus, in this embodiment, based on the timing of occurrence of a peak of current consumption at a start of document replacement of the ADF 2 as well as a peak of current consumption at a start of return of the scanner, and based on the braking time of the scanner depending on the copying scale factor, the timing at which a document replacement of the ADF 2 is started is delayed to a specified time, by which the current consumption of the system as a whole is suppressed to within the specified range so that the copying process can be continued comfortably.

Document Discharge Section

The document discharge section 140, as shown in FIG. 2, comprises a reverse roller 141, pinch rollers 142, 143 which make press contact with the reverse roller 141, a switching claw 144 provided near the reverse roller 141, a discharge roller 145, and a pinch roller 146 which makes press contact with the discharge roller 145, all of these members being covered with an openable/closable cover 147. A guide 148 is provided, ranging from the outlet of the document conveying section 120 through an opposed portion of the reverse roller 141 and the pinch roller 142 to the discharge roller 145, with a sheet path formed by this guide 148. Also, a guide 149 are provided, ranging from the switching claw 144 through an opposed portion of the reverse roller 141 and the pinch roller 143 to the outlet of the document conveying section 120, with a reversal path formed by this guide 149.

Figure 15A:
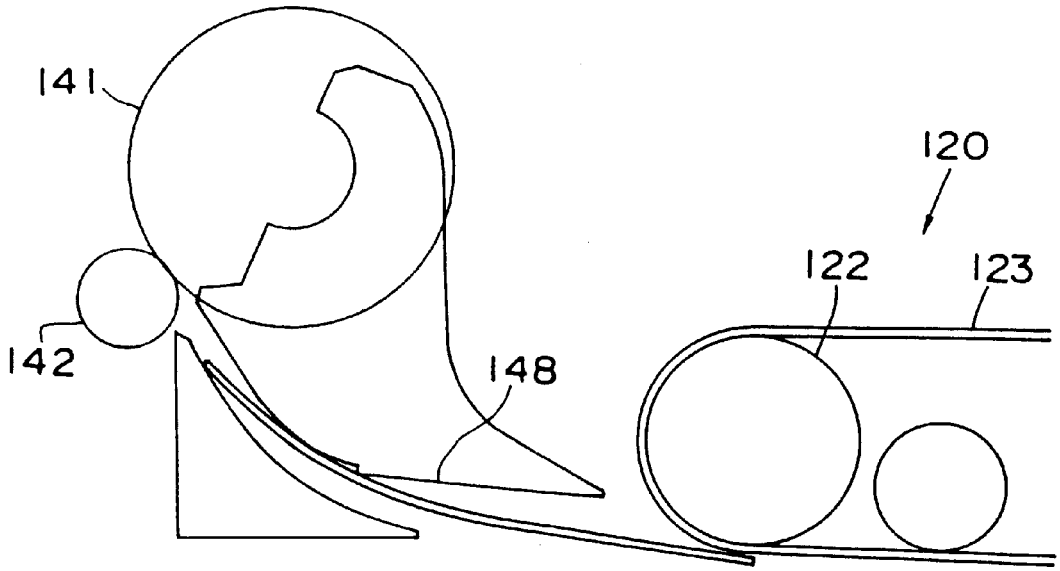
FIGS. 15A and 15B are sectional views showing the configuration of the paper-discharge path guide according to the prior art and the present invention, respectively.
Figure 15B:
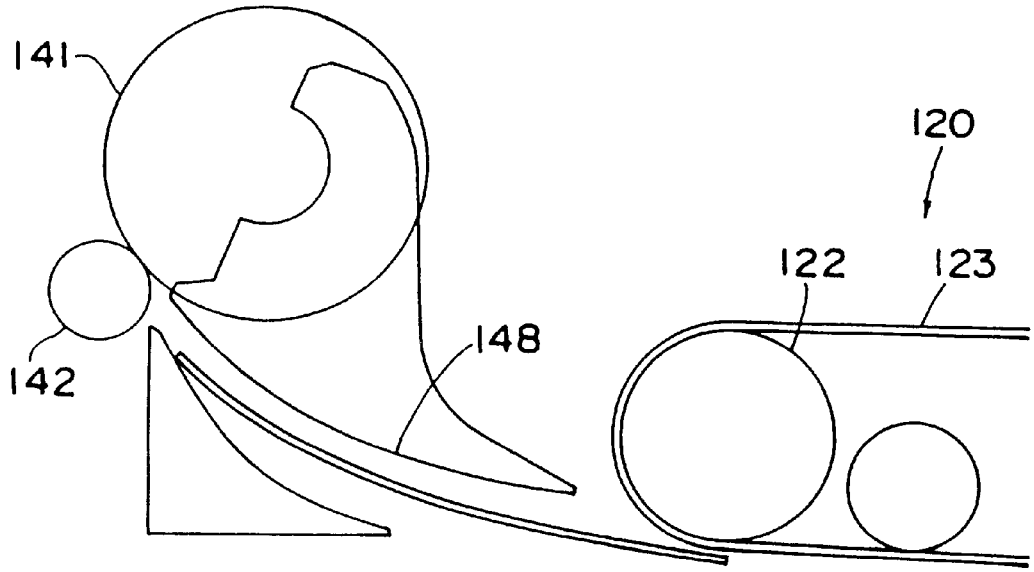

As shown in FIG. 15A, a document sheet which passes through the sheet path ranging from the document conveying section 120 to the reverse roller 141 is conveyed by the conveying force of the document conveying section 120. In this sheet path, a firm document sheet such as cardboard, in particular, when contacting the inner guide 148, would slip under increased resistance, thus no longer being discharged. Increasing the conveying force of the document conveying section 120 would cause a torque increase as well as wrinkles in the document sheet which would occur when the document sheet is stopped by being put into contact with the scale 125, unfavorably. Thus, in order to enable the document conveyance without increasing the conveying force of the document conveying section 120, as shown in FIG. 15B, the inner guide 148 that forms the sheet path ranging from the document conveying section 120 to the reverse roller 141 is formed in such a configuration as to fall inside the natural flexure curve of the document sheet having the maximum thickness that allows sheet passage from the outlet of the document conveying section 120 to the nip portion of the reverse roller 141 and the pinch roller 142. By doing so, the document sheet can be prevented from slipping so that the document sheet can be discharged reliably without increasing the conveying force of the document conveying section 120.

The reverse roller 141 can be driven to rotate clockwise in FIG. 2. The switching claw 144 is normally pivoting counterclockwise in FIG. 2, leading the document sheet to the upper sheet path. In the double-side mode, the switching claw 144 pivots clockwise from the state of FIG. 2 to a specified angle, leading the document sheet to the reversal path and returning it to the document conveyance path.

Figure 16:
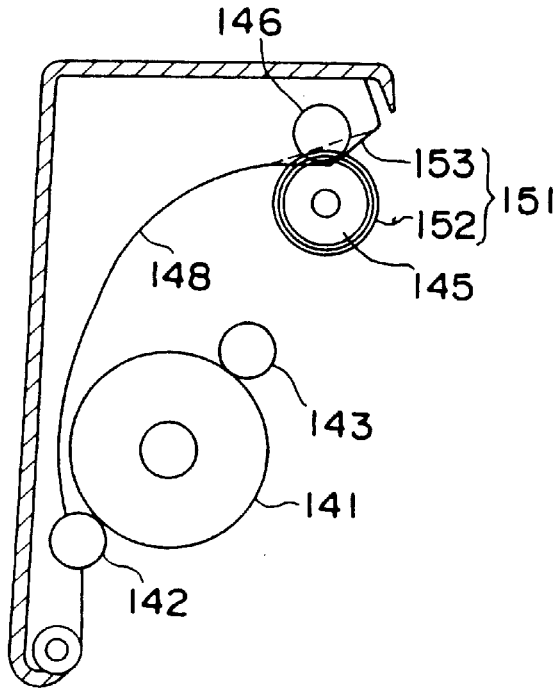
FIG. 16 is a sectional view showing the document urging mechanism of the paper discharge roller.
Figure 17:
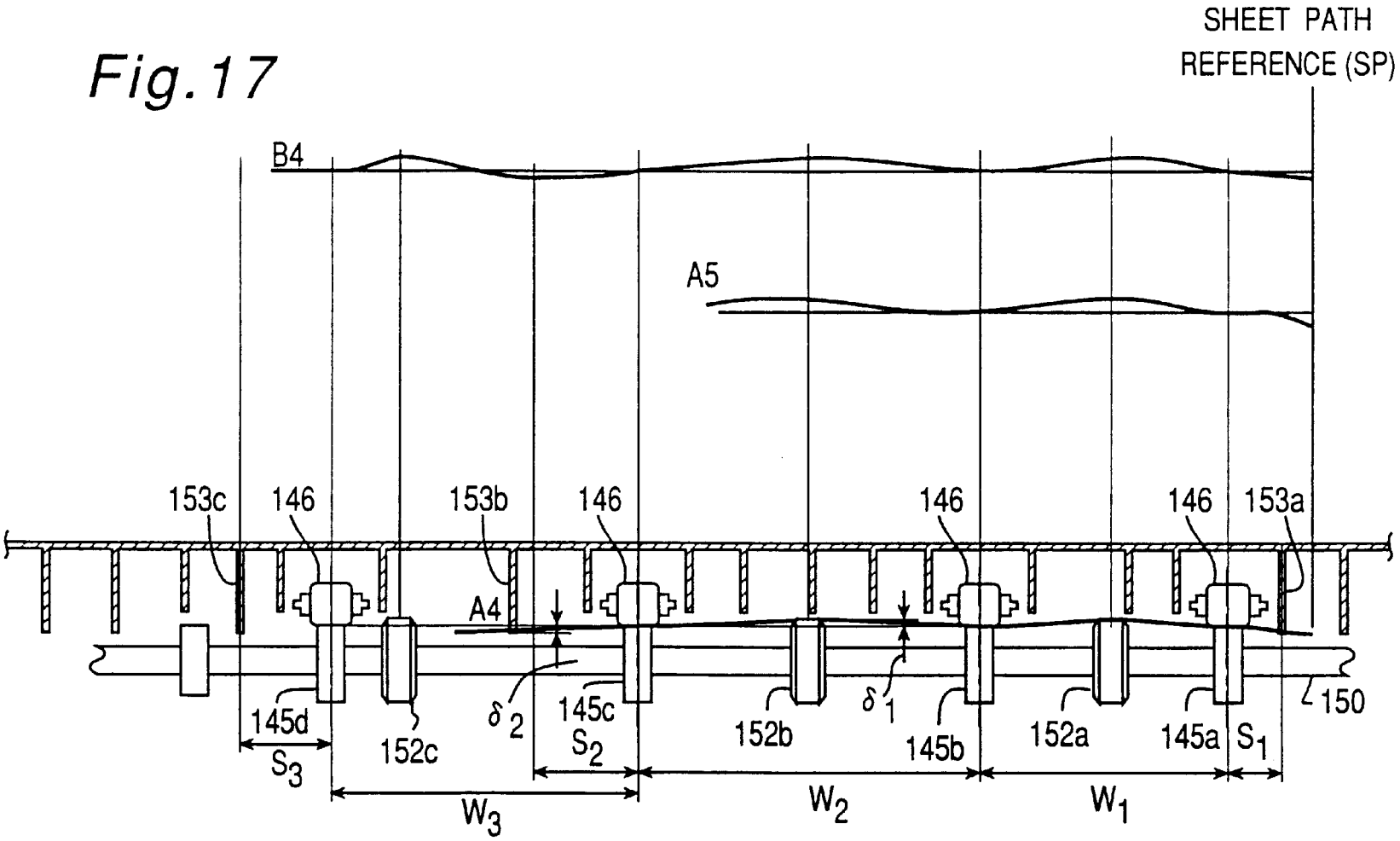
FIG. 17 is a front sectional view showing the document urging mechanism of the paper discharge roller.

The discharge roller 145 can be driven to rotate clockwise in FIG. 16. This discharge roller 145 comprises first, second, third and fourth discharge rollers 145*a*, 145*b*, 145*c* and 145*d* fixed to one rotating shaft 150 as shown in FIG. 17. These discharge rollers 145 are set to such intervals that all the passable sizes of document sheets can be discharged.

The discharge rollers 145 are equipped with a document urging mechanism 151 for urging the document sheet vertically to its surface in order to give a discharged sheet a curl extending in the document feed direction. This document urging mechanism 151 comprises a document urging roller 152 and a document urging rib 153.

The document urging roller 152 is fixed to the rotating shaft 150 of the discharge rollers 145. This document urging roller 152 comprises a first document urging roller 152*a* located intermediate between the first and second discharge rollers 145*a*, 145*b*, a second document urging roller 152*b* located intermediate between the second and third discharge rollers 145*b*, 145*c* and a third document urging roller 152*c* located between the third and fourth discharge rollers 145*c*, 145*d* and near the fourth discharge roller 145*d*. The diameter of these document urging rollers 152 is larger than the diameter of the discharge rollers 145, where one half of the diameter difference therebetween is the upward urging amount (δ1) against the document sheet.

The document urging rib 153 is extendedly provided downward of and on the edge of the guides 148 that form the sheet path, as shown in FIG. 16. This document urging rib 153, as shown in FIG. 17, comprises a first document urging rib 153*a* located on the sheet path standard side of the first discharge roller 145*a*, a second document urging rib 153*b* located on a side opposite to the sheet path standard side of the third discharge roller 145*c*, and a third document urging rib 153*c* located on a side opposite to the sheet path standard side of the fourth discharge roller 145*d*. The distance S1 between the first document urging rib 153*a* and the first discharge roller 145*a* is smaller than the distance W1 between the first discharge roller 145*a* and the second discharge roller 145*b*. The distance S2 between the second document urging rib 153*b* and the third discharge roller 145*c* is smaller than the distance W2 between the second discharge roller 145*b* and the third discharge roller 145*c*. The distance S3 between the third document urging rib 153*c* and the fourth discharge roller 145*d* is smaller than the distance W3 between the third discharge roller 145*c* and the fourth discharge roller 145*d*. In these document urging ribs 153, the size of projection formed by the four discharge rollers 145 from the conveyance surface is the downward urging amount (δ2) for the document.

When the document sheet of, for example, A4 size as shown in FIG. 17 passes through the discharge rollers 145 equipped with the above document urging mechanism 151, the document sheet is urged upward by the first and second document urging rollers 152*a*, 152*b* so that two upward curls are formed in the center of the sheet. Also, on both end portions of the discharged sheet, more rigid curls than those of the center are formed by the first and second document urging ribs 153*a*, 153*b*. If the document sheet is of A5 size, curls are formed on both sides of the document sheet by the first document urging rib 153*a* and the second document urging roller 152*b*. If the document sheet is of B4 size, strong curls are formed by the third document urging roller 152*c*. As a result of firm curls being formed on both side end portions in this way, the discharged sheet is discharged as keeping in the curled shape and will never loose the rigidity until it separates from the discharge rollers 145. Thus, the discharged document sheet is free from occurrence of twist at the front end, so that it is loaded onto the document tray 60 without causing already discharged document sheets to be fed out or to fly up.

Figure 18:
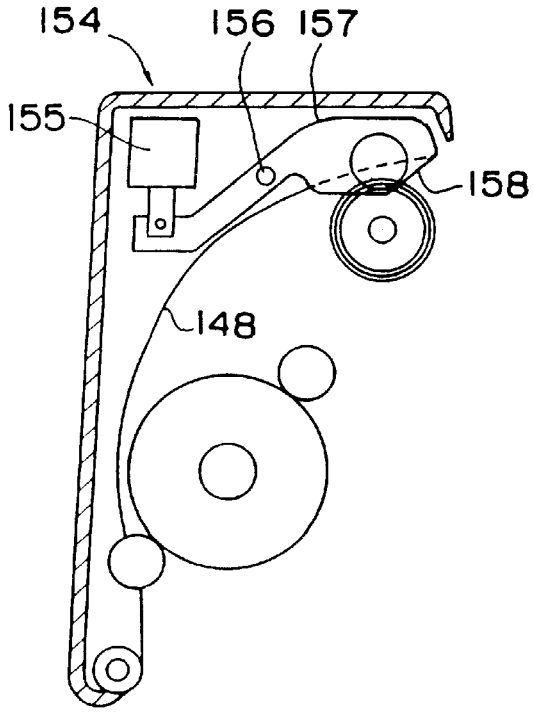
FIG. 18 is a sectional view showing another document urging rib of the paper discharge roller.

FIG. 18 shows a document urging mechanism 154 in which the urging amount is adjustable and which is used in place of the document urging mechanism 151 as described before. This document urging mechanism 154 comprises a solenoid 155 fitted to the guides 148, and a lever 157 fitted to the guides 148 so is to be rotatable by a pivot 156. One end of the lever 157 is fitted to the plunger of the solenoid 155, and a document urging protrusion 158 is formed at the other end. Provided that the discharged document sheet is of ordinary paper quality, the solenoid 155 is turned off, where a certain level of urging amount (δ1) is given to the document. Provided that the discharged document sheet is of relatively hard paper quality like Kent paper, the solenoid 155 is turned on, where the lever 157 pivots clockwise in FIG. 18 so that an urging amount larger than the ordinary (δ1+α) is given to the document. In this way, curls can be formed by imparting appropriate urging amounts depending on the type of document.

Figure 19:
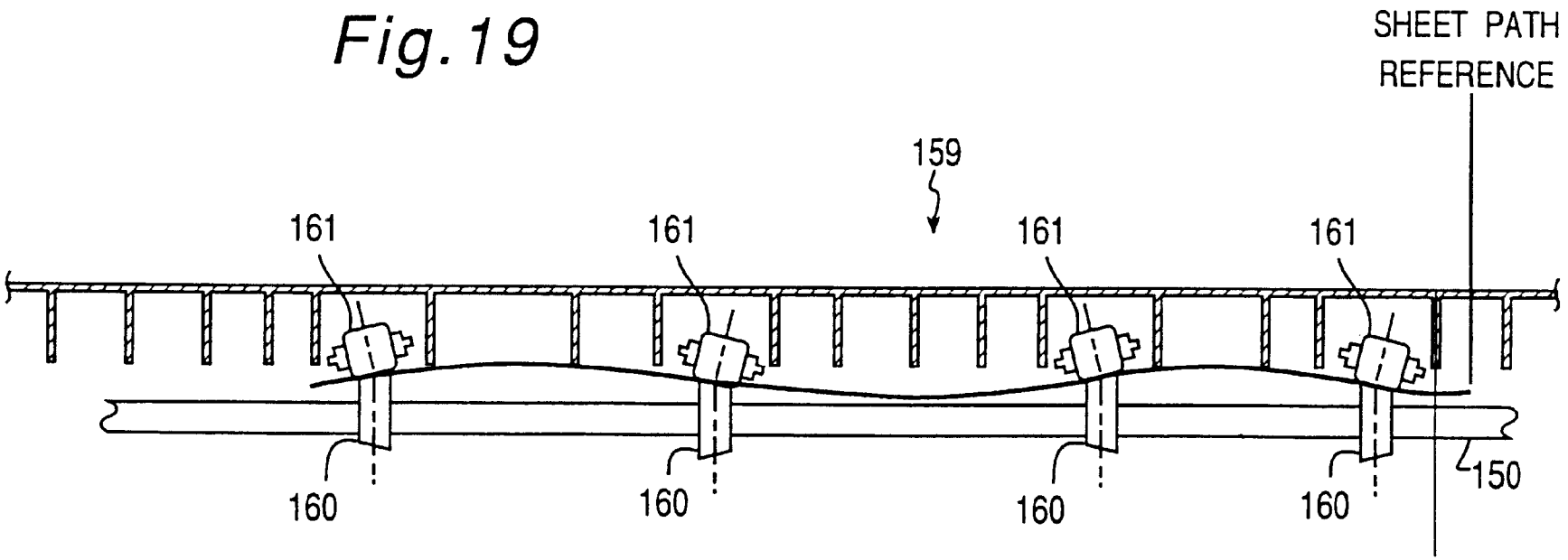
FIG. 19 is a front sectional view showing another document urging mechanism of the paper discharge roller.

FIG. 19 shows another embodiment for imparting curls to the document. This curl imparting mechanism 159 comprises a plurality of discharge rollers 160 of a truncated cone shape, and pinch rollers 161 making press contact with the outer circumferential surfaces of these discharge rollers 160. According to this curl imparting mechanism 159, curls can be imparted to the document sheet without urging the document sheet. It is of course possible to combine this curl imparting mechanism 159 with the document urging mechanisms 151, 154.

Document Restricting Section

Figure 20:
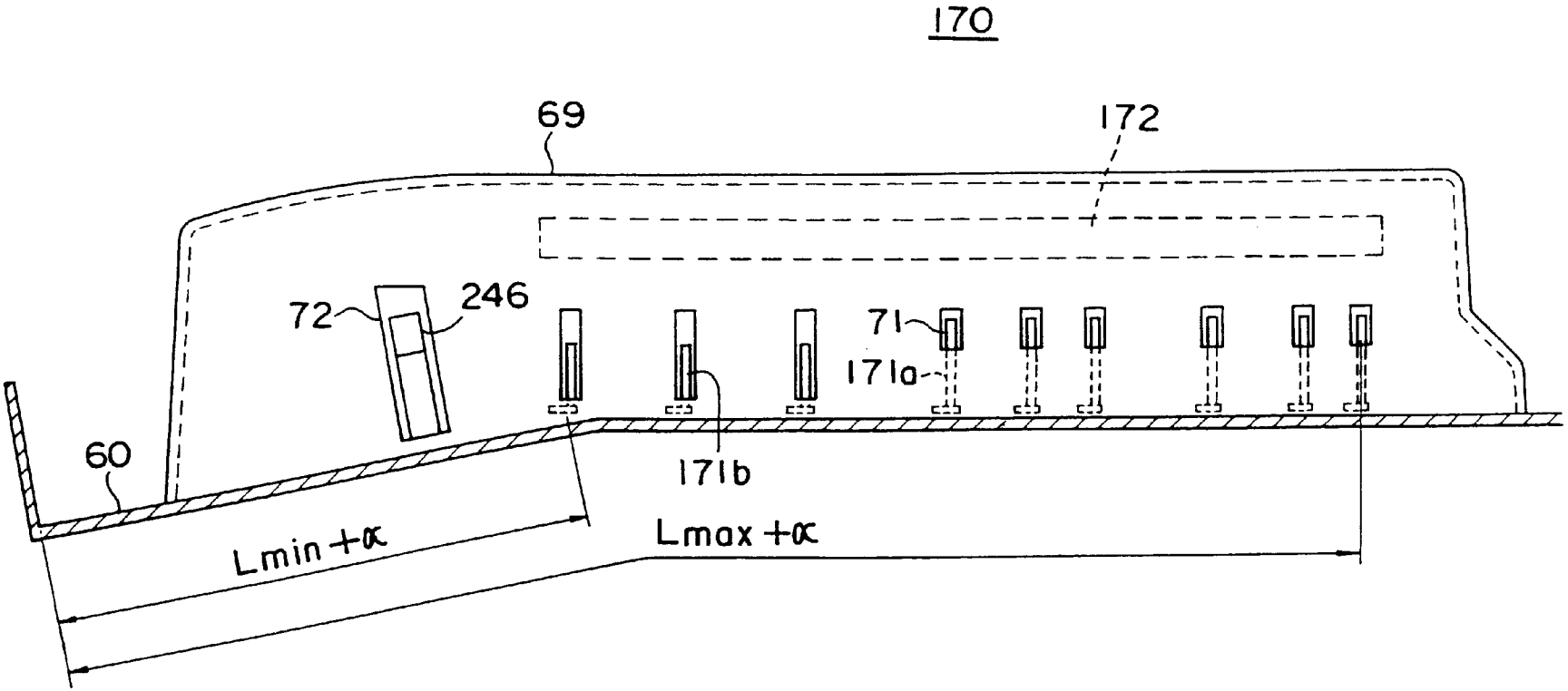
FIG. 20 is a front view of the document regulator.

The document restricting section 170 is designed to restrict the front end of the document sheet discharged from the document discharge section 140 and, as shown in FIG. 20, comprises a plurality of discharged-document stopper mechanisms 171 and a drive mechanism 172 for driving the discharged-document stopper mechanisms 171.

The discharged-document stopper mechanisms 171 are disposed nine in number correspondingly to the document size inside the fixed document-restricting plate 69 and along the document feed direction. In more detail, they are provided at a position of the farthest distance (Lmax+α) from the upstream end of the document tray 60 in the document feed direction for documents of the longest size (Lmax) in the document feed direction, and at a position of the nearest distance (Lmin+α) from the upstream end of the document tray 60 in the document discharge direction for documents of the shortest size (Lmin) in the document feed direction. For documents of the almost same length in the document feed direction, the same discharged-document stopper mechanisms 171 can be used to achieve a simplification in construction and a reduction in cost. Six discharged-document stopper mechanisms 171*a* on the downstream side of the document discharge direction slightly differ in configuration from three discharged-document stopper mechanisms 171*b* on the upstream side. Hereinafter, the former will be referred to as A type discharged-document stopper mechanisms 171*a*, and the latter as B type discharged-document stopper mechanisms 171*b*.

FIG. 21 shows the A type discharged-document stopper mechanism 171*a*. This A type discharged-document stopper mechanism 171*a* is housed in the holder 173 fitted inside the fixed document-restricting plate 69 and comprises a stopper 174 and a lever 175.

The stopper 174 is formed into an inverted L shape by a first arm portion 176 and a second arm portion 177. One end of the first arm portion 176 is fitted to the lower end of the holder 173 by a pivot 178 so as to be pivotable between a withdrawal position depicted by solid line and a restrictive position depicted by two-dot chain line. Also, the stopper 174 is urged counterclockwise in the figure by an unshown spring, by which the second arm portion 177 is protruded from a rectangular opening 71 formed in the fixed document-restricting plate 69, making contact with the top surface of the document tray 60. The outer edge of the second arm portion 177 is formed into an arc shape around the pivot 178 as a center.

The lever 175 comprises a first lever 180 one end of which is fitted to the upper end of the holder 173 so as to be pivotable by a pivot 179, and a second lever 181 which is fitted to the front end of the first lever 180 so as to be pivotable by a pivot 182. The first lever 180 is urged counterclockwise in the figure about the pivot 179 by an unshown spring. The second lever 181 has an engaging portion 184 which makes contact with an engaging portion 183 of the first lever 180 so that the second lever 181 will pivot counterclockwise about the pivot 182 but not pivot clockwise. At a front end of the second lever 181, is provided a protrusion 185 which makes contact with the inner edge of the first arm portion 176 of the stopper 174.

Figure 21A:
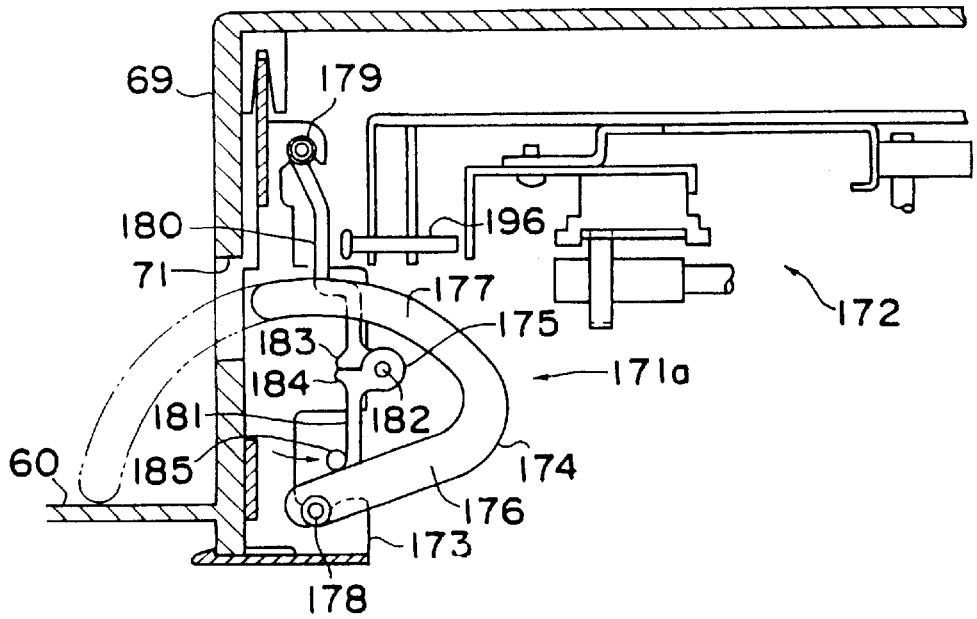
FIG. 21 is a sectional view sequentially showing operations of the A type discharged-document stopper mechanism.
Figure 21B:
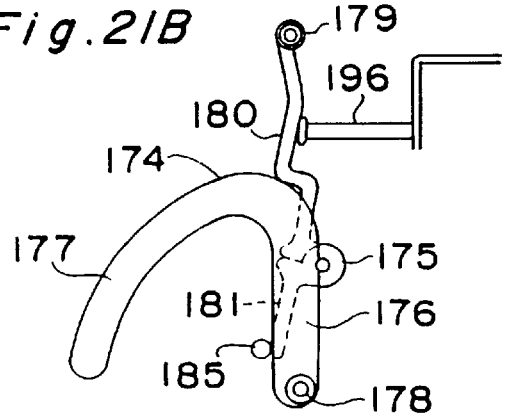
Figure 21C:
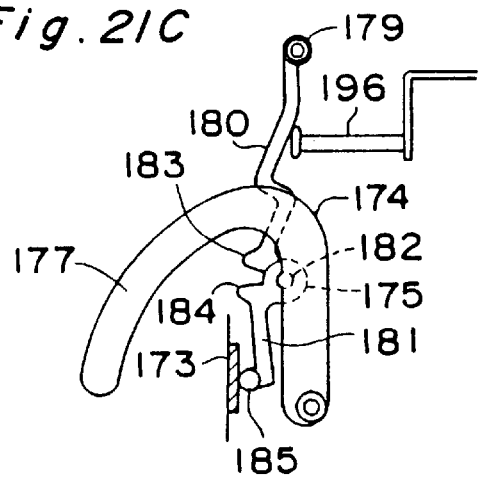

In the discharged-document stopper mechanism 171, the counterclockwise urging force of the lever 175 about the pivot 179 is set Larger than the counterclockwise urging force of the stopper 174 about the pivot 178. Due to this, when the lever 175 is not pressed by a later-described drive pin 196 of the drive mechanism 172 as shown in FIG. 21A, the protrusion 185 of the lever 175 presses the stopper 174 in the direction of arrow, so that the stopper 174 is positioned in the withdrawal position, where the stopper 174 is withdrawn inside the document restricting plate 69. Also, when the lever 175 is pressed by the drive pin 196 as shown in FIG. 21B, the lever 175 pivots clockwise about the pivot 179, causing the protrusion 185) of the lever 175 to try to separate from the inner edge of the stopper 174, so that the stopper 174 accordingly pivots about the pivot 178 by its own urging force. As a result of this, the stopper 174 has its seconds arm portion 177 protruded from the opening 71 of the fixed document-restricting plate 69 so as to come into press contact with the document tray 60, being stopped in the restrictive position. Further, when the lever 175 is pressed by the drive pin 196, the protrusion 185 of the lever 175 separates from the inner edge of the stopper 174, coming into contact with the holder 173 as shown in FIG. 21C. As a result of this, the engaging portion 183 of the first lever 180 and the engaging portion 184 of the second lever 181 are separated from each other, resulting in bent state. Therefore, even with a large drive stroke of the drive pin 196, the lever 175 will never be broken.

Figure 22:
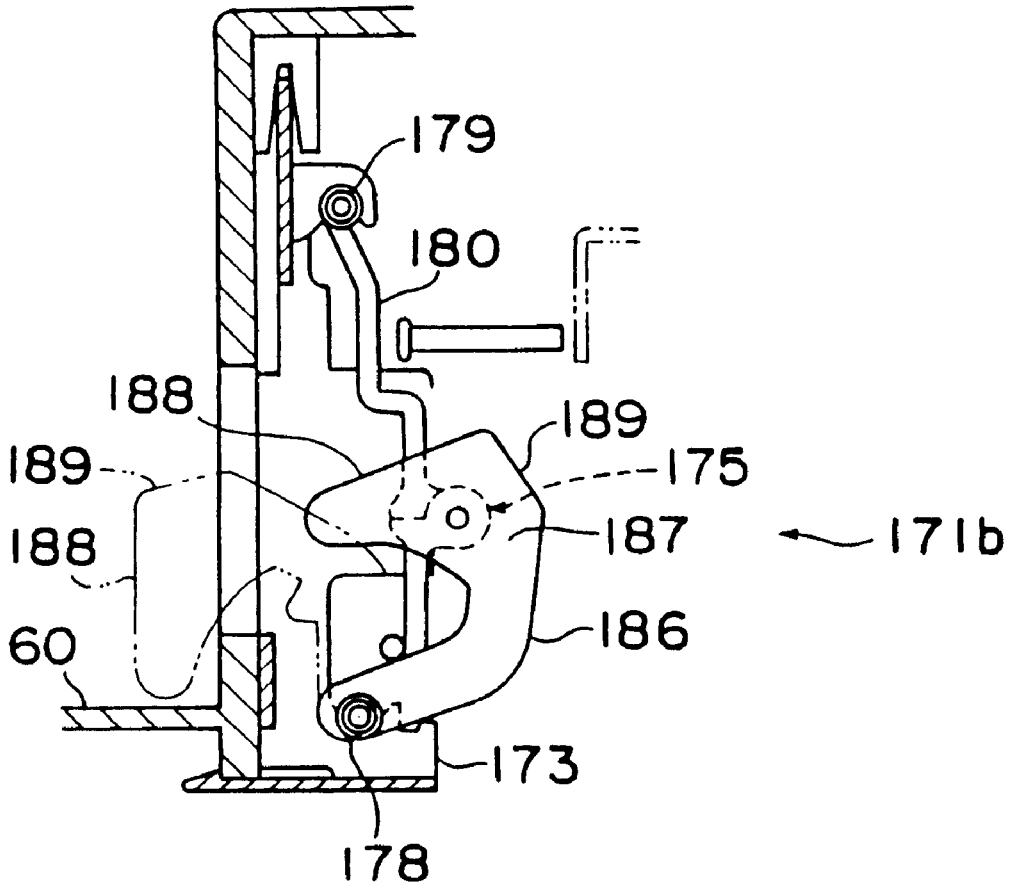
FIG. 22 is a sectional view showing the B type discharged-document stopper mechanism.

FIG. 22 shows the B type discharged-document stopper mechanism 171*b*. Because this stopper mechanism is similar to the A type discharged--document stopper mechanism 171*a* except the configuration of a stopper 186, corresponding parts are designated by like reference numerals and their description is omitted. As to the configuration of the stopper 186, the outer edge of a second arm portion 187 is formed by two linear edges 188, 189. When the stopper 186 is in the restrictive position, the first linear edge 188 on the front end side is vertical to the document tray 60 and the second linear edge 189 is tilted to the document tray 60.

Figure 23:
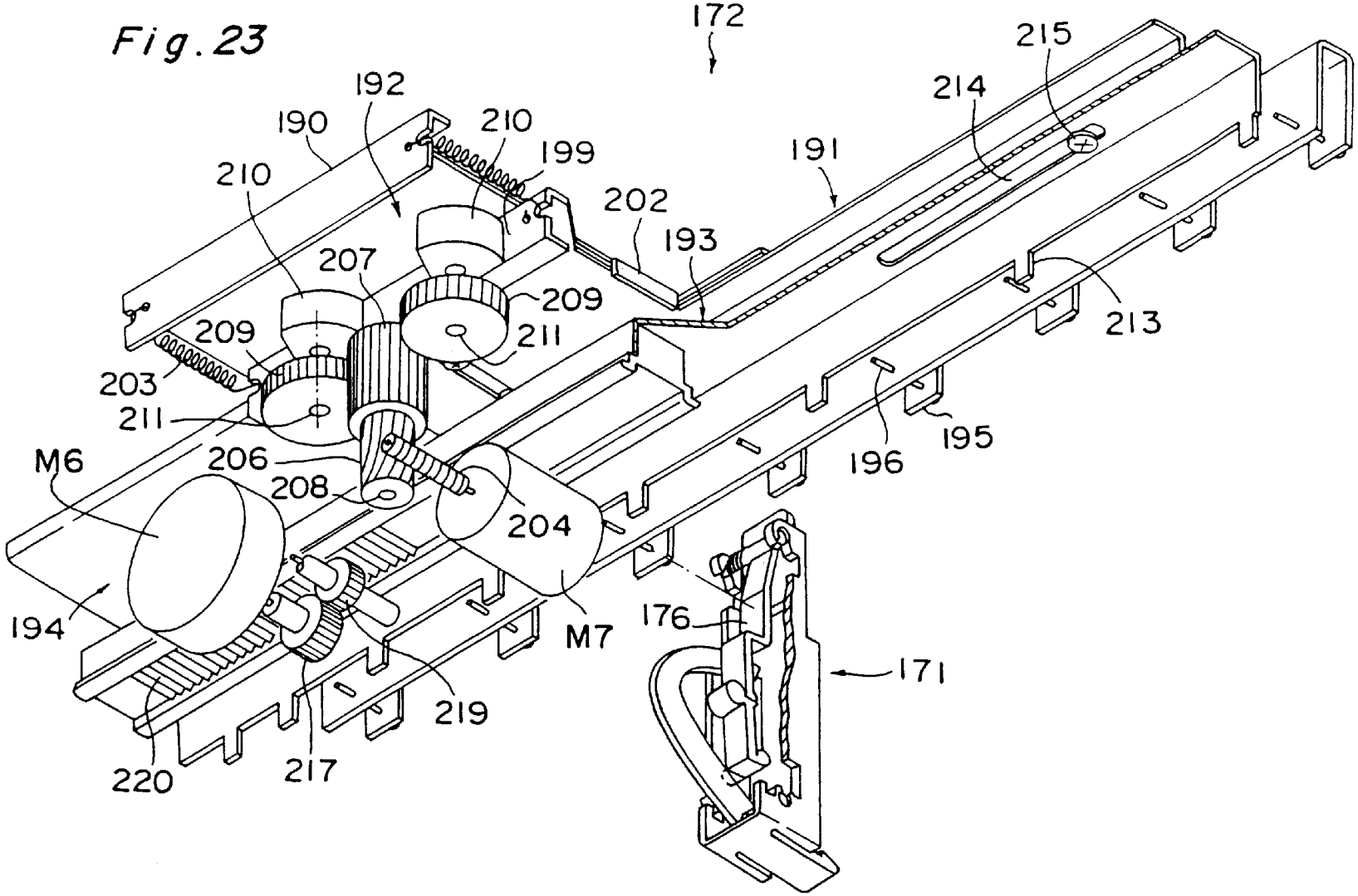
FIG. 23 is a perspective view showing the drive mechanism for the discharged-document stopper mechanism.

The drive mechanism 172 of the discharged-document stopper mechanism 171, as shown in FIG. 23, comprises a fixed frame 190, a first slider 191, a first drive mechanism 192 for driving the first slider 191 into sliding, a second slider 193, and a second drive mechanism 194 for driving the second slider 193 into sliding.

The fixed frame 190 is fixed inside the fixed document-restricting plate 69, and has a drive-pin holder 195 at a position opposite to the lever 175 of the discharged-document stopper mechanism 171. This drive-pin holder 195 is inverted-U shaped so that the drive pin 196 is slidably held so as to advance and withdraw with respect to the lever 175 of the discharged-document stopper mechanism 171.

Figure 24:
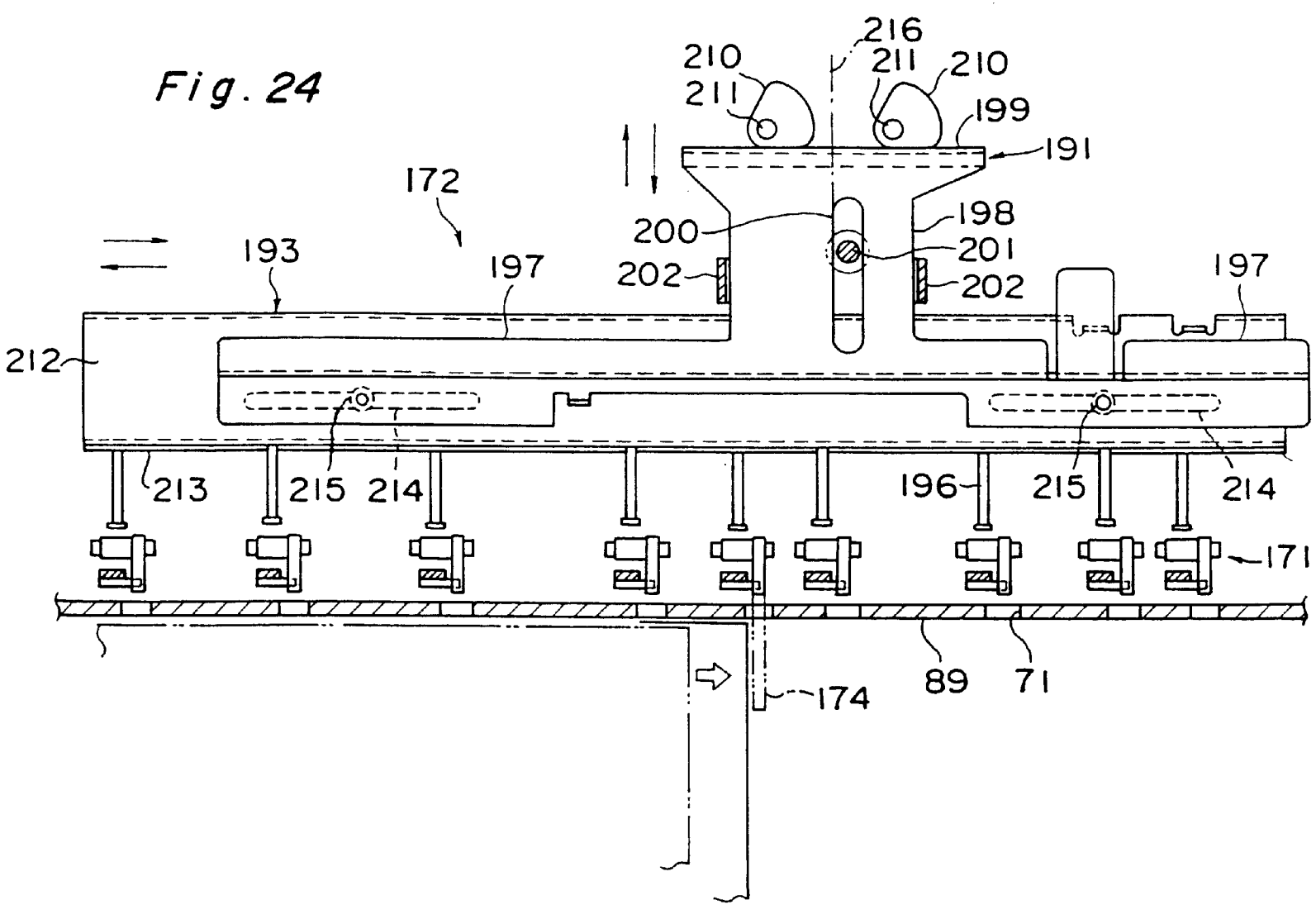
FIG. 24 is a plan view showing the drive mechanism for the discharged-document stopper mechanism.

The first slider 191, as shown in FIG. 24, a second slider holding portion 197 extending in the document feed direction, and a driver 198 extending from a generally center of the second slider holding portion 197 in a direction perpendicular to the document feed direction. A front end of the driver 198 is bent downward to form a drive surface 199 with which a later-described cam 210 of the first drive mechanism 192 comes into press contact. Also, a long hole 200 extending in a direction perpendicular to the document feed direction is formed in the driver portion 198. A screw 201 is inserted into this long hole 200 so as to be screwed into the fixed frame 190, by which the first slider 191 is fitted to the fixed frame 190. Then, the first slider 191 is slidable in a direction perpendicular to the document feed direction by both side edges of the driver 198 being guided by guides 202 formed in the fixed frame 190. Also, the first slider 191 is urged depthwise by springs 203 fitted between both ends of the drive surface 199 and the fixed frame 190 as shown in FIG. 23.

The first drive mechanism 192, as shown in FIG. 23, comprises a CD alignment motor M7 having a worm 204 fitted to its drive shaft, a coupling shaft 208 having a worm wheel 206 and a gear 207 to be screwed with the worm 204 of the CD alignment motor M7, and two cam shafts 211 each having a gear 209 and a cam 210 to be screwed with the gear 207 of the coupling shaft 208. As the CD alignment motor M7 rotates, the cam shafts 211 is rotated via the coupling shaft 208, so that the first slider 191 is reciprocatingly slid in a direction perpendicular to the document feed direction.

The second slider 193, as shown in FIG. 24, comprises a base portion 212 extending in the document feed direction, and a plurality (nine in this embodiment, but not limited to this) of pressing portions 213 protruding downward from a downwardly bent side edge of the base portion 212. A long hole 214 is formed at both end portions of the base portion 212, and the second slider 193 is slidable in the document feed direction with respect to the first slider 191 by inserting a screw 215 into this long hole 214 and thereby inserting it into the first slider 191. The plurality of pressing portions 213 are positioned at specified intervals in the document feed direction. In addition, the long hole 200 and the screw 201, by which the slide shaft of the first slider 191 is formed, are preferably located near the axis of symmetry of the two cam shafts 211 of the first drive mechanism 192. With this arrangement, when the pressing portions 213 that are the farthest from the slide shaft press the stopper 174 via the drive pins 196, the first slider 191 will operate smoothly without effecting prying action.

The second drive mechanism 194, as shown in FIG. 23, comprises a FD alignment motor M6 having a gear 217 fitted to its drive shaft, a pinion 219 to be engaged with the gear 217 of the FD alignment motor M6, and a rack 220 which is fitted to the lower surface of the base portion 212 of the second slider 193 and with which the pinion 219 is engaged. As the FD alignment motor M6 rotates, the rack 220 is moved via the gear 217 and the pinion 219, so that the second slider 193 moves in the document feed direction along with the rack 220.

Figure 25:
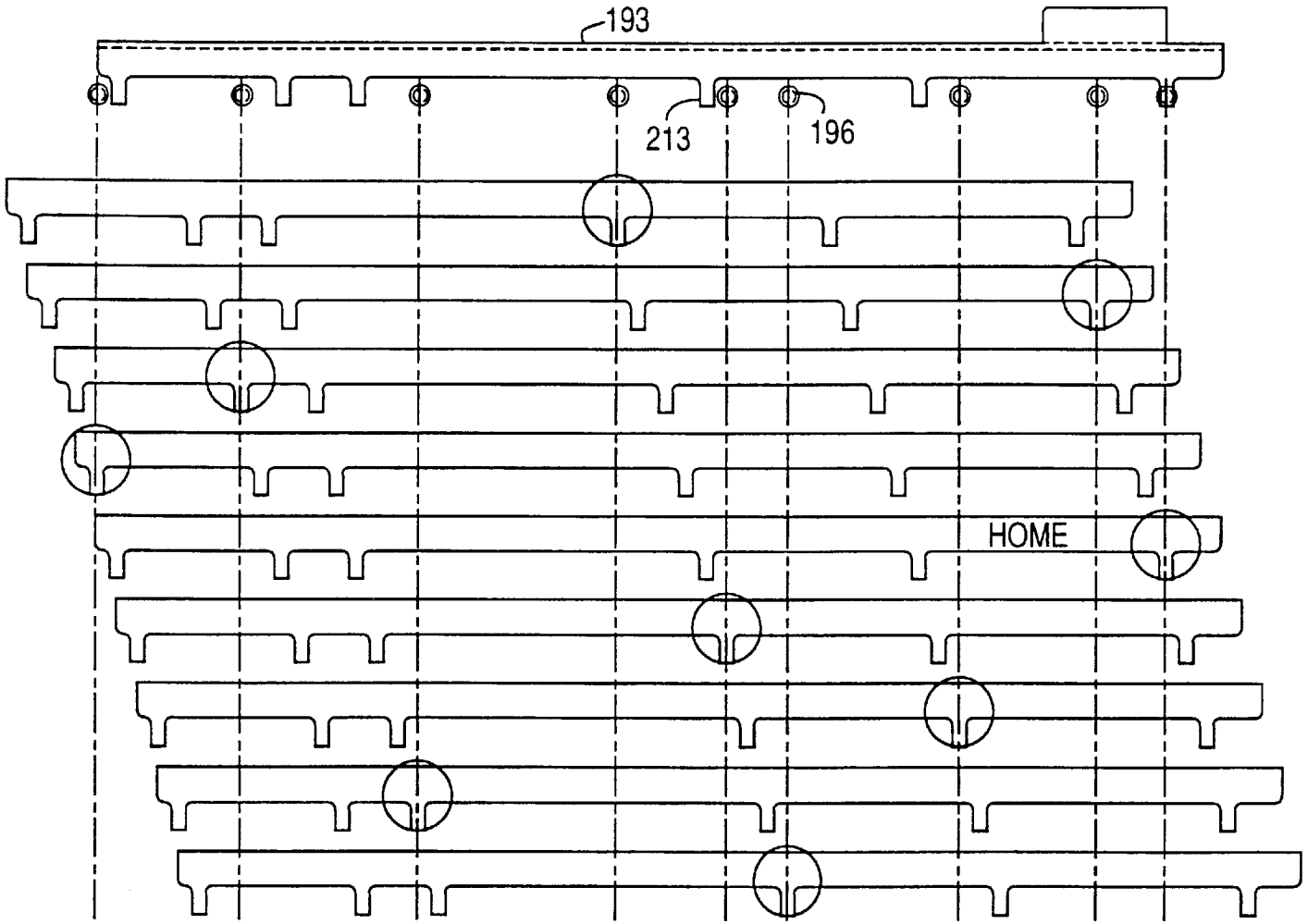
FIG. 25 is a view showing operation of the drive mechanism for the discharged-document stopper mechanism.

FIG. 25 shows the positional relation between pressing portions 213 and drive pins 196 of the second slider 193. When the second slider 193 is in the home position, pressing portions 213 encircled on the most downstream side of the document feed direction are opposed to drive pins 196 on the most downstream side of the feed direction. Each time the second slider 193 moves in steps of a specified distance from the home position toward the upstream side of the document feed direction, some one of the encircled pressing portions 213 is opposed to some one of the drive pins 196. Besides, each time the second slider 193 moves in steps of a specified distance from the home position toward the downstream side of the document feed direction, some one of the encircled pressing portions 213 is opposed to some one of the drive pins 196. The second slider 193, having a plurality of pressing portions 213 as shown above, results in the shortest travel so that some one of the pressing portions 213 can be opposed to a desired drive pin 196 promptly.

In the document restricting section 170 of the above-described constitution, when the first document sheet is fed and discharged, a discharged-document stopper mechanism 171 is selected according to the document size entered by the user or to the document size detected at the feed of the first document sheet. Then, the second slider 193 is moved by the second drive mechanism 194 so that the one of the pressing portions 213 is opposed to the drive pin 196 corresponding to the selected discharged-document stopper mechanism 171. Subsequently, the first slider 191 is slid in the direction perpendicular to the document feed direction by the pivoting of the cam 210 of the first drive mechanism 192, by which the pressing portion 213 presses the drive pin 196 corresponding to the selected discharged-document stopper mechanisms 171. As a result, the lever 175 of the discharged-document stopper mechanism 171 is pressed by the drive pin 196, thus pivoting, so that the stopper 174 pivots from the withdrawal position to the restrictive position, resulting in press contact on the document tray 60 in the case of smaller document size or press contact on the fed document placed on the document tray 60 in the case of large document size. Accordingly, the front end of the discharged document sheet meets the stopper 174 on its discharge path, and pulled in, as it is, so as to be aligned.

For the document restricting section 170, when document sheets of sizes larger than that of the first sheet are included, it is preferable that the stopper 174 is returned from the restrictive position to the withdrawal position in order to prevent the document sheets from meeting the discharged-document stopper 174 and being thereby damaged on its way of discharge. In this case, a stopper 174 corresponding to the pertinent different size is actuated from the withdrawal position to the restrictive position. Also, when the stopper 174 has come to no longer withdraw due to some fault of sensors, motors or the like, it is preferable to prevent the use of the document conveying apparatus because of a possibility that the stopper 174 may remain on the document tray 60, making it impossible to set the next document, or that the discharged sheet may be caught, damaging the document.

Another embodiment of the document restricting section 170 is now explained.

Figure 26:
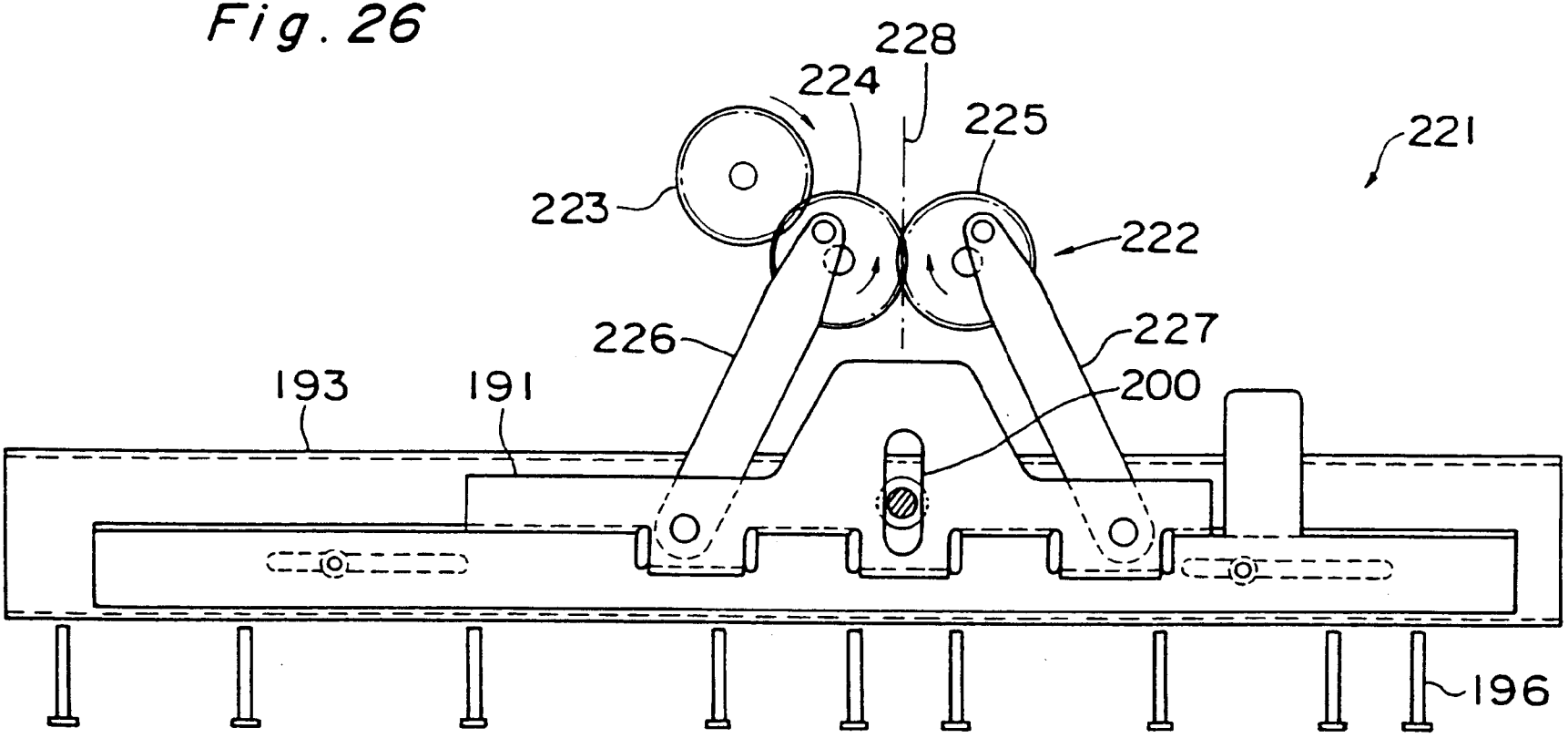
FIG. 26 is a plan view showing another drive mechanism for the discharged-document stopper mechanism.

FIG. 26 shows a drive mechanism 221 of another embodiment for driving the discharged-document stopper mechanism 171. This drive mechanism 221 is substantially the same as the foregoing drive mechanism of FIG. 24 except that a first drive mechanism 222 for driving the first slider 191 is a link mechanism. Therefore, corresponding members are designated by like reference numerals and omitted in description.

The first drive mechanism 222 comprises a drive gear 223 fitted to a drive shaft of an unshown motor, a first link gear 224 to engage with the drive gear 223, a second link gear 225 to engage with the first link gear 224, a first link 226 one end of which is pivotably fitted to the first link gear 224 with eccentricity and the other end of which is pivotably fitted to the first slider 191, and a second link 227 one end of which is pivotably fitted to the second link gear 225 with eccentricity and the other end of which is pivotably fitted to the first slider 191. The first and second links 226, 227 are arranged symmetric with respect to an axis of symmetry 228 given by the center line between the first and second link gears 224, 225. Then, the long hole 200 of the first slider 191 is formed on this axis of symmetry 228.

In this drive mechanism 221, when the drive gear 223 has rotated clockwise to a specified angle, the first and second link gears 224, 225 are rotated in opposite directions so that the first and second links 226, 227 press and slide the first slider 191. With the drive gear 223 rotated to a further specified in the same direction, the first and second links 226, 227 pull up and slide the first slider 191. By such a sliding action of the first slider 191, the discharged-document stopper mechanism 171 is driven like the foregoing, so that the discharged-document stopper 174 is moved to the withdrawal position and the restrictive position.

Figure 27:
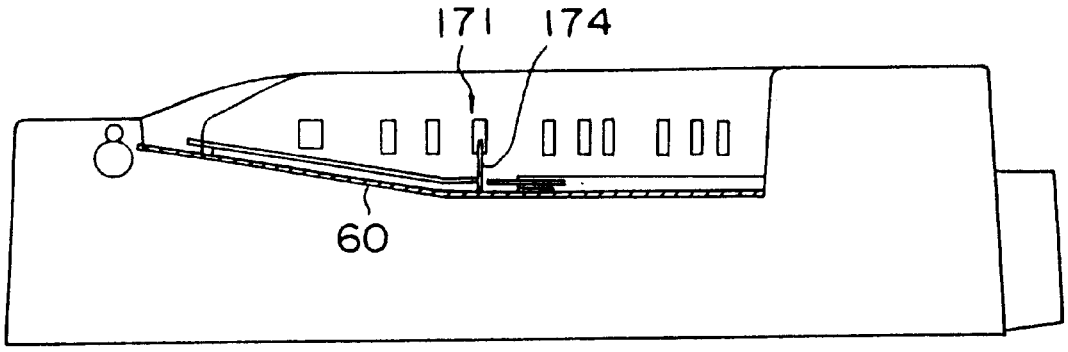
FIG. 27 is a view showing another means for end regulation of the discharged document.

FIG. 27 shows a case in which when different sizes of document sheets are included in the fed document sheets, the document tray 60 is so formed as to be higher on the discharge side and lower on the feed side with a view to reliably achieving the front end restriction of the discharged document sheets by the stopper 174 of the discharged-document stopper mechanism 171.

Figure 28:
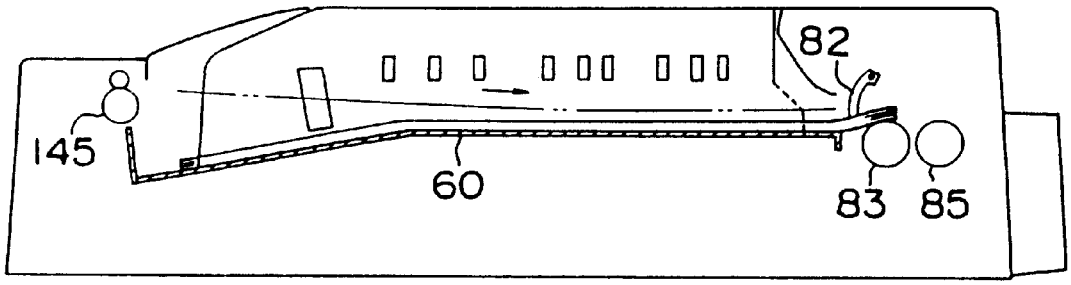
FIG. 28 is a view showing another means for end regulation of the discharged document.

FIG. 28 shows a case in which the refeed preventing member 82 for sorting fed document sheets and discharged document sheets serves also as a discharged-document restricting stopper corresponding to large-size document sheets.

Figure 29:
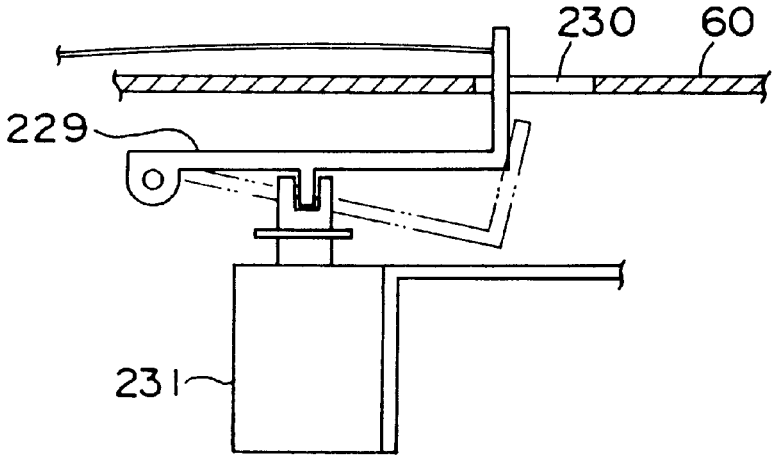
FIG. 29 is a sectional view showing another means for end regulation of the discharged document.

FIG. 29 shows a case in which a discharged-document stopper 229 is provided inside the document tray 60 so as to be protruded upward through an opening 230 formed in the document tray 60 by a solenoid 231. In this case, because the space below the document tray 60 can be effectively utilized, the apparatus can be prevented from upsizing.

Document Move Preventing Section

Figure 30:
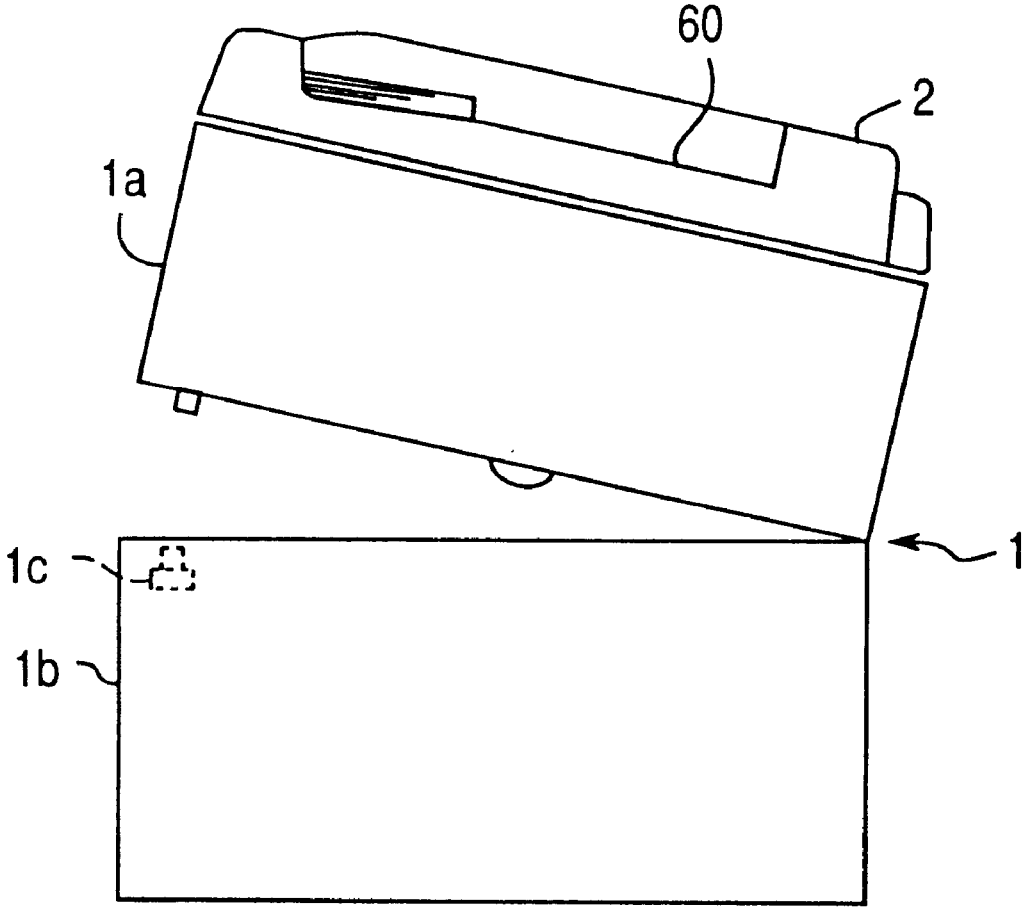
FIG. 30 is a front view of a copying machine showing a state that upper part of the copying machine main body is opened.
Figure 31:
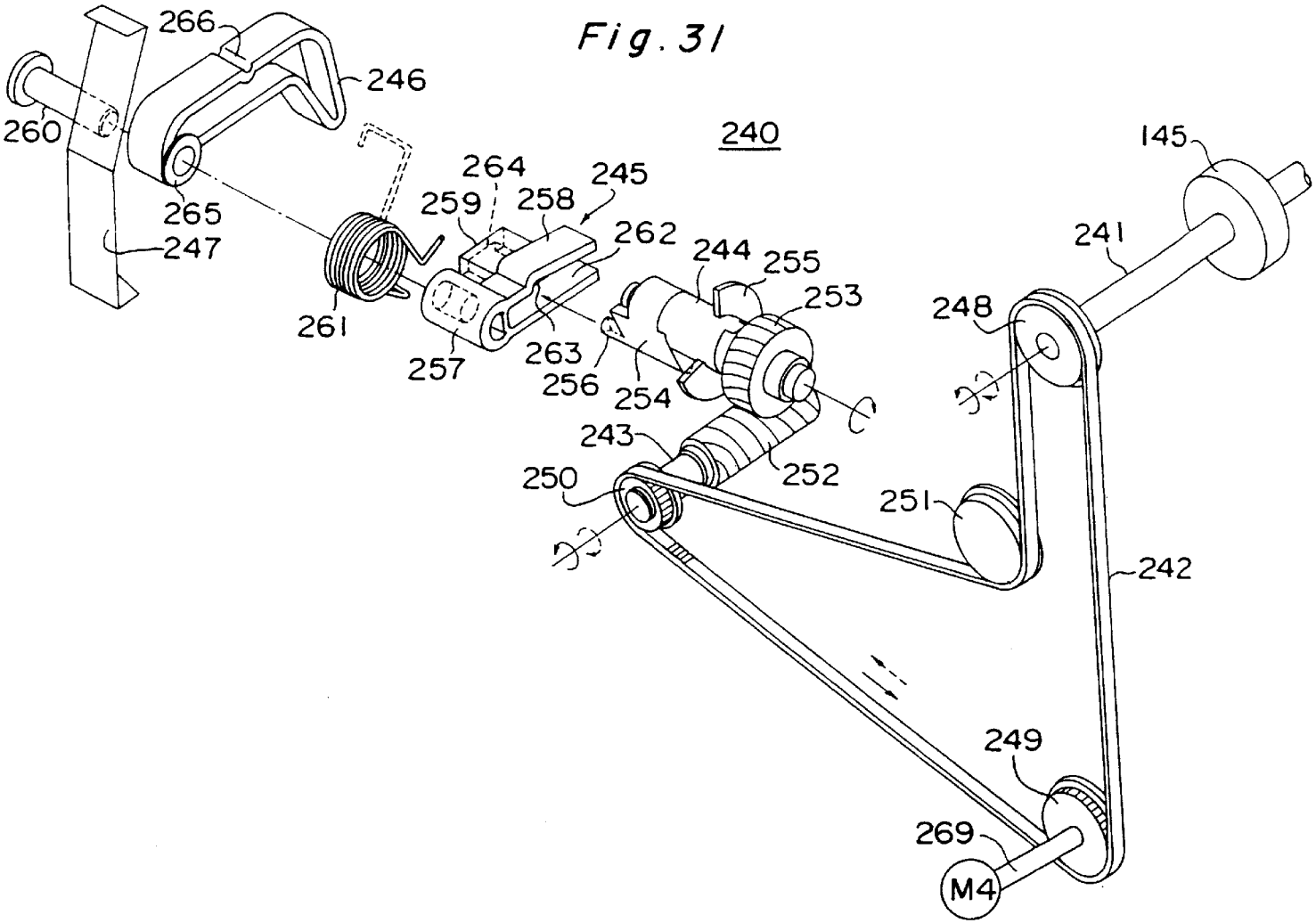
FIG. 31 is a perspective view of the document move preventer.

A document move preventing section 240, as shown in FIG. 30, is designed to prevent the document sheets on the higher position side on the document tray 60 (discharged document sheets in this embodiment) from moving when an upper machine body 1*a* of the copying machine main body 1 is opened for jam processing or the like. This document move preventing section 240, as shown in FIG. 31, generally comprises a drive shaft 269, a transmission belt 242, a transmission shaft 243, a crank shaft 244, a slider 245, a document-pressing lever 246 and a plate spring 247.

The drive shaft 269 is driven into forward and reverse rotation by a discharge motor M4. The drive shaft 269 serves as a drive shaft for the discharge roller 145 when rotating forward, and as a drive shaft for the document move preventing section 240 when rotating reverse. Like this, the drive shaft 269 can be implemented by the existing drive shaft for the discharge roller 145, thus eliminating the need of providing any special drive unit.

The transmission belt 242 is stretched on a pulley 248 provided to the discharge roller 145, a drive pulley 249, and a later-described one-way clutch 250 provided to the transmission shaft 243, and adjusted in tensile force by a presser pulley 251.

The transmission shaft 243 is supported by an unshown shaft parallel to a drive shaft 241 for the discharge rollers 145, and has the one-way clutch 250 and a worm 252. The one-way clutch 250 has the transmission belt 242 stretched thereon. The one-way clutch 250 does not transmit power to the transmission shaft 243 for the rotation in the direction of the solid-line arrow (forward rotation of the discharge roller 145), and transmits power for the rotation in the direction of broken-line arrow (reverse rotation of the discharge roller).

The crank shaft 244 is supported by an unshown frame so as to be perpendicular to the transmission shaft 243, and has a worm wheel 253 to be engaged with the worm 252, a crank arm 254, and a detector plate 255 for detecting the rotational angle by an unshown sensor. An engaging shaft 256 protruding parallel to the crank shaft 244 is provided at a front end of the crank arm The slider 245 comprises a shaft portion 257, an arm portion 258 extending perpendicularly from the shaft portion 257, and an engaging portion 259 extending from the arm portion 258 parallel to the shaft portion 257. The shaft portion 257 is rotatably supported by a pivot 260 eccentric to the crank shaft 244 together with the document-pressing lever 246. A twist spring 261 is fitted to this shaft portion 257. In the arm portion 258, is formed a slide groove 262 with which the engaging shaft 256 formed at the front end of the crank arm 254 of the crank shaft 244 is slidably engaged. On one side surface of this slide groove 262, is formed an engaging recess 263. In the engaging portion 259, is formed a recess 264 with which one end of the torsion spring 261 is engaged.

Figure 32A:
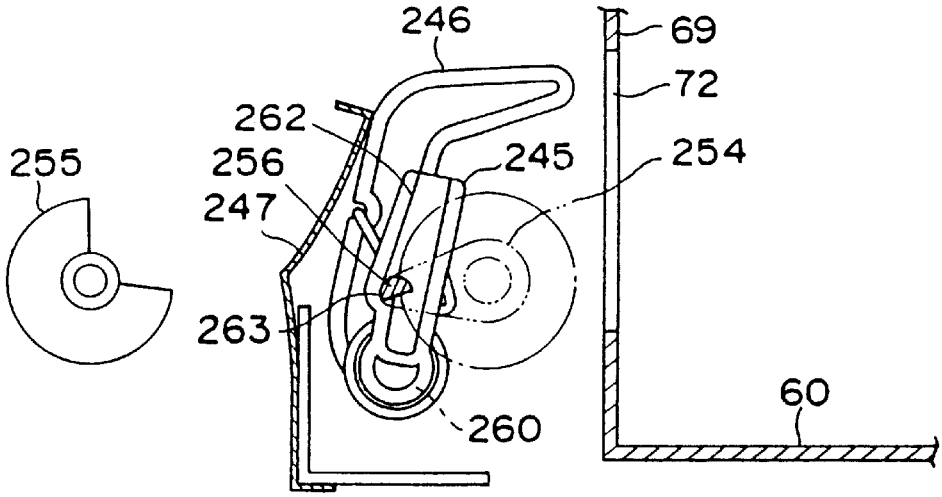
FIG. 32 is a sectional view sequentially showing operations of the document move preventing mechanism.

The document-pressing lever 246 is generally L-shaped, and has the pivot 260 inserted into its shaft portion 265. Also, the other end of the torsion spring 261 is engaged with a groove 266 formed in the rear surface of the document-pressing lever 246, by which the document-pressing lever 246 and the slider 245 are urged in such a direction as to overlap with each other as shown in FIG. 32, and are stabilized by the engaging portion 259 of the slider 245 being engaged with the document-pressing lever 246. The document-pressing lever 246 is pivotable between a withdrawal position where it is withdrawn inside the fixed document-restricting plate 69 as shown in FIG. 32A, and a press position where an end of the document-pressing lever 246 is protruded from the opening 72 formed in the fixed document-restricting plate 69 so as to press the top surface of the discharged document sheet placed on the document tray 60.

The plate spring 247 is intended to urge the document-pressing lever 246 and the slider 245 clockwise in FIG. 32 when the document-pressing lever 246 is in the withdrawal position, in order to prevent the engaging shaft 256 of the crank shaft 244 from separating off from the engaging recess 263 of the slide groove 262 of the slider 245.

In the document move preventing section 240 of the above-described constitution, in the normally state, the engaging shaft 256 of the crank shaft 244 is engaged with the engaging recess 263 of the slider 245, so that the document-pressing lever 246 is positioned in the withdrawal position. In this state, when a sensor 1*c* provided on the lower machine body 1*b* has detected that the upper machine body 1*a* has been slightly opened or that the lever for opening the upper machine body 1*a* has been operated as shown in FIG. 30, or when such an abnormal situation is detected that the machine body 1 must have the upper machine body 1*a* opened due to paper jam or the like, the discharge motor for the discharge rollers 145 rotate reverse.

Figure 32B:
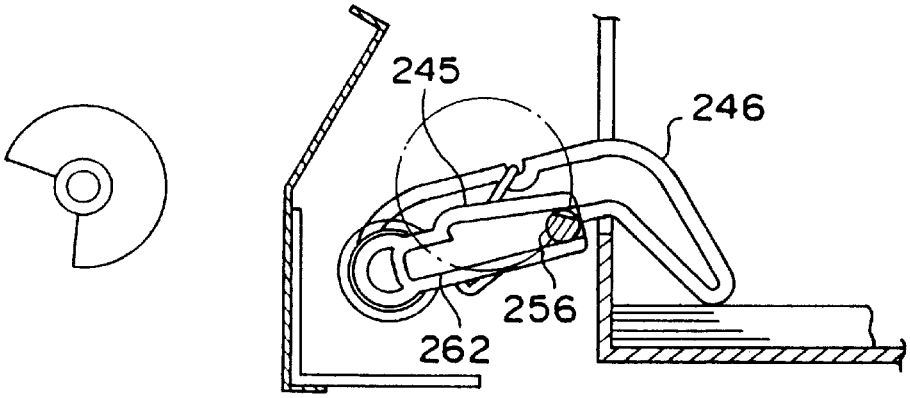

Accordingly, the drive shaft 241 for the discharge rollers 145 rotate in the direction of the solid-line arrow, the rotational force being transmitted to the one-way clutch 250 of the transmission shaft 243 via the transmission belt 242 so that the transmission shaft 243 rotates in the direction of the broken-line arrow. As a result of this, the crank shaft 244 rotates in the direction of arrow, and as the engaging shaft 256 of the crank shaft 244 slides within the slide groove 262 of the slider 245, the slider 245 and the document-pressing lever 246 integrally pivot clockwise in FIG. 32A about the pivot 260. Then, as shown in FIG. 32B, the document-pressing lever 246 is protruded from the opening 72 of the fixed document-restricting plate 69, making contact with the top surface of the discharged document sheet on the document tray 60.

Figure 32C:
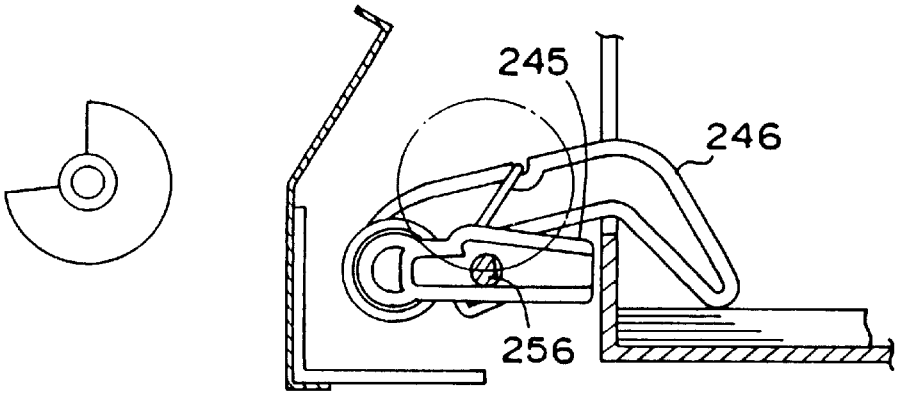

As the crank shaft 244 continues rotating further, only the slider 245 rotates as shown in FIG. 32C so that the torsion spring 261 is twisted to an extent of the pivoting difference between this slider 245 and the document-pressing lever 246, by which a pressing force is imparted to the document-pressing lever 246. When this occurs, an unshown sensor detects the off edge of the detector plate 255, stopping the reverse rotation of the discharge rollers 145. In this way, the discharged document sheets on the document tray 60 are pressed by the document-pressing lever 246, so that even if document tray 60 is tilted with the upper machine body 1*a* of the copying machine main body 1 opened, the higher-place discharged document sheets are prevented from moving to lower places.

When the upper machine body 1*a* of the copying machine main body 1 has been returned, upon detection of that, the discharge rollers 145 rotate reverse once again. As the engaging shaft 256 of the crank shaft 244 slides within the slide groove 262 of the slider 245, the slider 245 pivots counterclockwise, causing the pressing force of the document-pressing lever 246 to be released. Subsequently, the slider 245 pivots counterclockwise along with the document-pressing lever 246, returning to the withdrawal position. In this process, upon engagement of the engaging shaft 256 of the crank shaft 244 with the engaging recess 263 of the slide groove 263, an unshown sensor detects the on edge of the detector plate 255, causing the reverse rotation of the discharge motor.

In addition, under the forward rotation of the discharge rollers 145, the one-way clutch 250 does not transmit their rotational force to the transmission shaft 243, but it may occur that slight rotational force is transmitted by frictional force. In this case, however, the crank shaft 244 has its engaging shaft 256 engaged with the engaging recess 263 as shown in FIG. 32A, so that the slider 245 is prevented from rotating. Thus, the document-pressing lever 246 will never operate.

In the above embodiment, movement of the discharged document sheets is prevented by providing the document move preventing section 240 on the discharge side. Otherwise, when the discharge side becomes the higher with the upper machine body la of the copying machine main body 1 opened, the document move preventing section 240 may be provided on the feed side to prevent the movement of the discharged document sheets. In this case, use can be made of the reverse rotation of the pickup rollers 83 and the separating rollers 85.

It is also possible that, instead of pressing the document from above by the document-pressing lever 246 as in the foregoing embodiment, the document-pressing lever 246 is put into press contact with the document tray 60 on the downstream side of the document end so as to restrict the lower-place end portion of the document, thus preventing its movement.

Further, without providing any special document move preventing section 240 as in the foregoing embodiment, the existing document pressing plate 84 provided above the pickup rollers 83 of the document feed section 80 may be utilized to prevent the movement of the fed document sheets.

Document Refeed Moving Section

Figure 33:
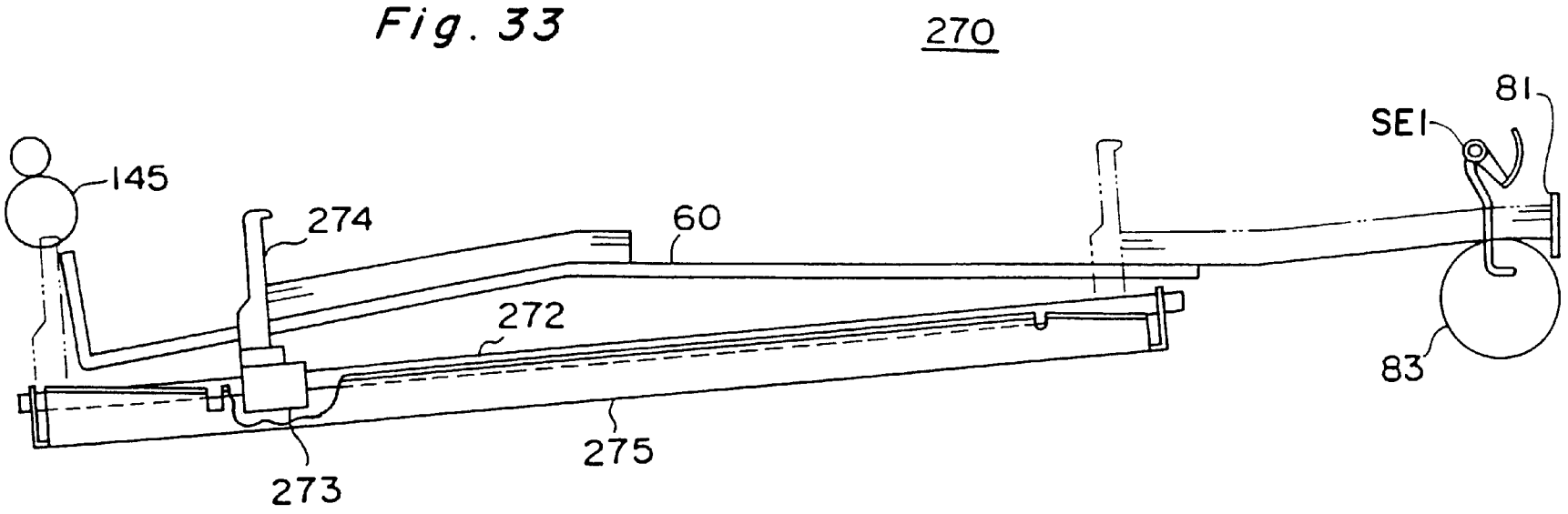
FIG. 33 is a front view of the document refeeding mover.
Figure 34:
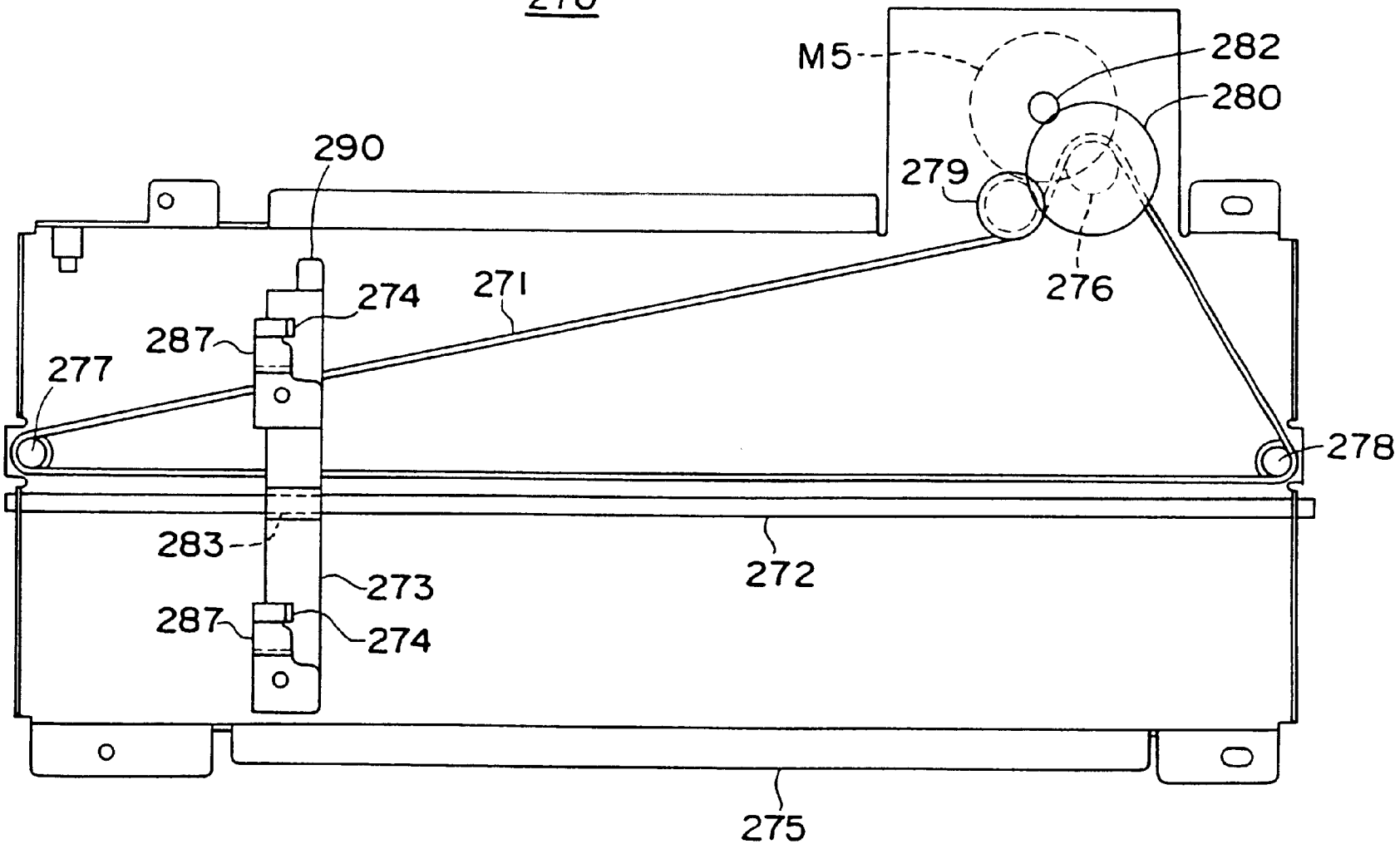
FIG. 34 is a plan view of the document refeeding mover.

The document refeed moving section 270 is intended for, when the document recirculation mode has been set, moving discharged document sheets to the feed port 61 to refeed them, or moving the discharged document sheets to the center of the document tray 60 to make it easy to take out the document sheets. This document refeed moving section 270, as shown in FIGS. 33 and 34, comprises a moving belt 271, a guide rail 272, a slider 273 and refeed levers 274, all of these members being provided inside the document tray 60.

The moving belt 271 is stretched on the three pulleys 276, 277, 278 arranged into a triangle on a base plate 275, and adjusted in tensile force by a presser pulley 279. Longer sides of the moving belt 271 are parallel to the document feed direction. This moving belt 271 is reciprocatingly movable by the gear 282 of the document moving motor M5 being screwed to a gear 280 provided to one pulley 276.

The guide rail 272 comprises a straight rod having a circular cross section, and is supported at both ends by a base plate 275 so as to be parallel in adjacency to the longer sides of the moving belt 271.

Figure 35:
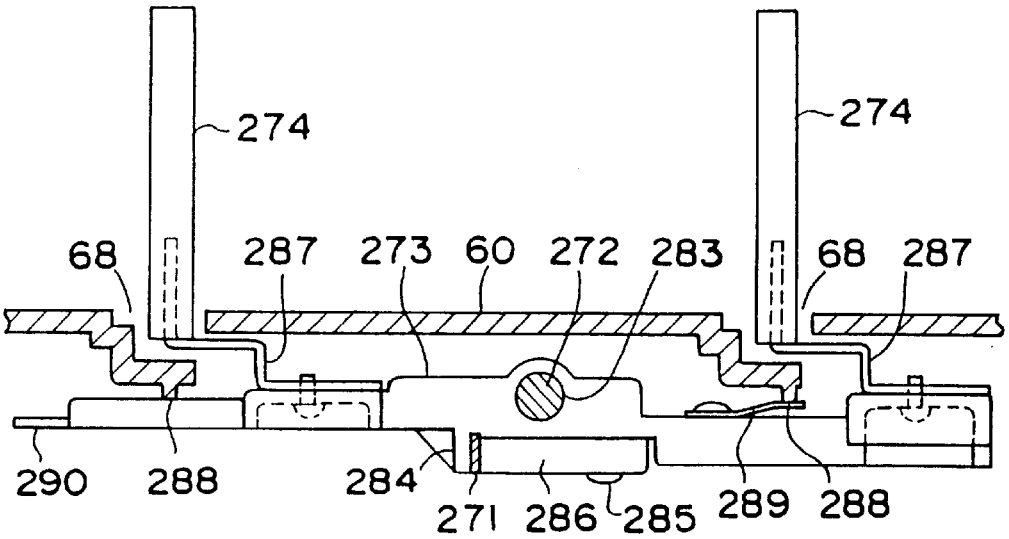
FIG. 35 is a plan view of the document refeeding mover.

The slider 273 is shaped into an elongate plate and, as shown in FIG. 35, has the guide rail 272 inserted into a through hole 283 bored in the center of the slider 273. Also, the moving belt 271 is pinched between a protrusion 284 protrusively provided to the rear surface of the slider 273 and an end surface of a spacer plate 286 attached by a screw 285. This allows the slider 273 to be reciprocatingly slidable on the guide rail 272 along with the movement of the moving belt 271. On upper surfaces of both wings of the slider 273, are attached generally L-shaped metal fittings 287, as described later, for attaching the refeed levers 274. One wing of the slider 273 makes contacts with a protrusion 288 formed on the lower surface of the document tray 60, while a plate spring 289 making press contact with another protrusion 288 is attached to the top surface of the other wing. With this arrangement, the slider 273 is prevented from rattling while a height with respect to the document tray 60 in the direction of gravity is formed. At an end of the slider 273, a detector plate 290 for detecting the home position of the slider 273 with a sensor is protrusively provided.

Figure 36A:
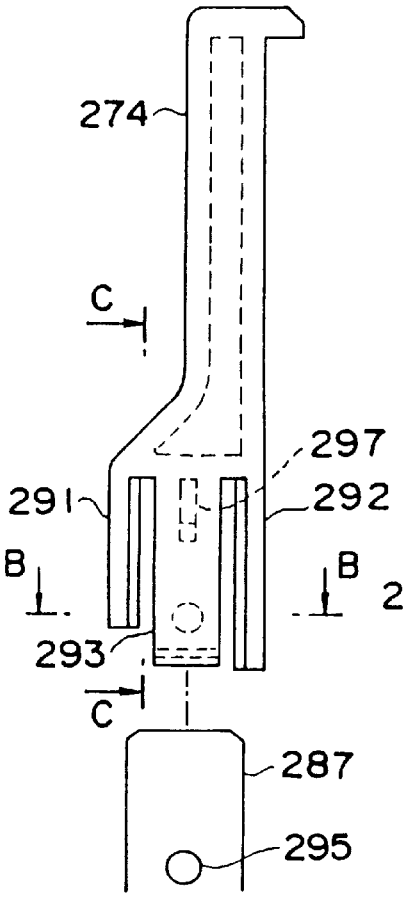
FIGS. 36A, 36B and 36C are a front view of the refeed lever, a sectional view taken along the line B—B of FIG. 36A and a sectional view taken along the line C—C of FIG. 36A.
Figure 36B:
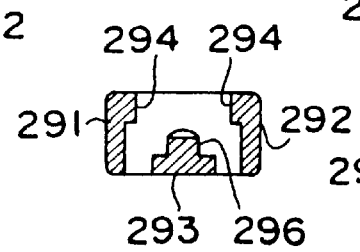
Figure 36C:
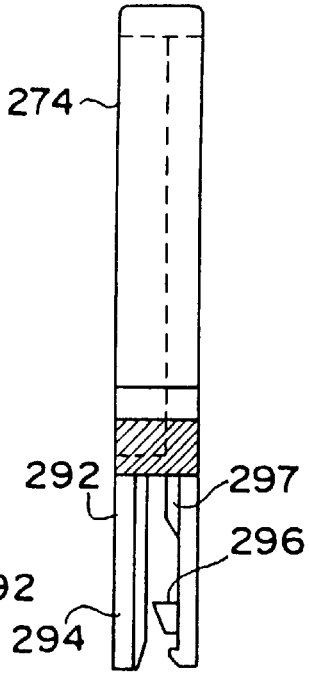

The refeed levers 274 are removably fitted to the front ends of the metal fittings 287 at both wings of the slider 273 in a fitting structure as described below, so as to be protruded above the two grooves 68 formed on the document tray 60. That is, as shown in FIG. 36, first and second projecting pieces 291, 292 opposed to each other in the document feed direction, as well as a third projecting piece 293 located between these projecting pieces 291, 292 are protrusively provided at the lower ends of the refeed levers 274. On the opposed surfaces of the first and second projecting pieces 291, 292, linear projections 294 are formed in the vertical direction. Then, the first and second projecting pieces 291, 292 having these linear projections 294 and the third projecting piece 293 form a space into which the end of the metal fitting 287 is inserted. A columnar protrusion 296 to be engaged with an engaging hole 295 formed in the metal fitting 287 is protrusively provided in the inner surface of the front end of the third projecting piece 293 and a reinforcing rib 297 is formed in the inner surface of the base. The front end of the protrusion 296 is tapered in the direction of insertion of the metal fittings 287.

In this fitting structure, when the lower end of the refeed lever 274 is inserted into the metal fitting 287, the tapered face of the protrusion 296 first makes contact with the front end of the metal fitting 287, causing the third projecting piece 293 to be opened outward. As the refeed lever 274 is further pushed in, the protrusion 296 of the third projecting piece 293 is engaged with the engaging hole 295 of the metal fitting 287 so as to be prevented from falling off. Next, for removal of the refeed lever 274, the third projecting piece 293 is flexed outward so that the protrusion 296 is uncoupled from the engaging hole 295, and then the refeed lever 274 may be pulled up.

Figure 37A:
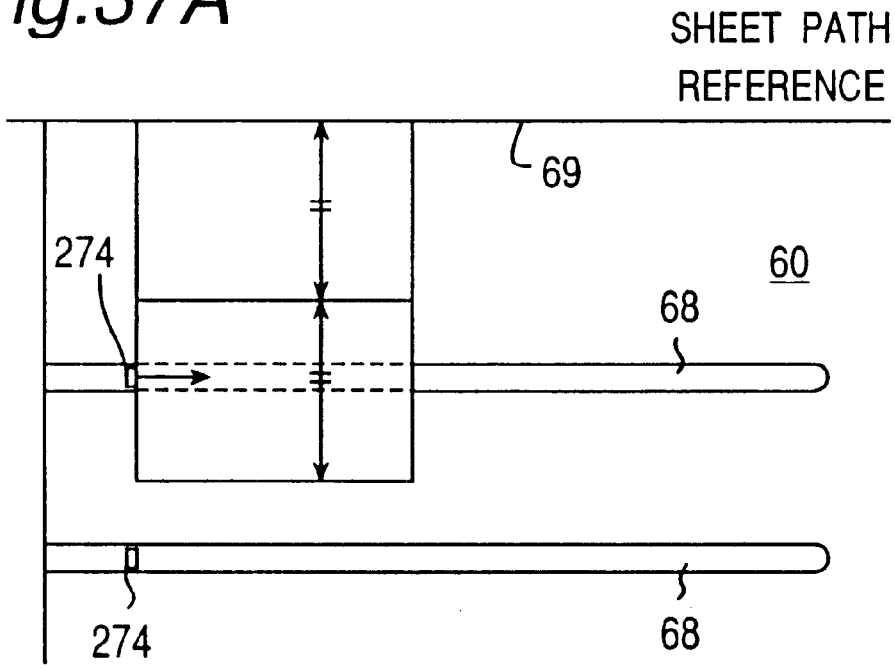
FIG. 37 is a view for explaining a position where the refeed lever is pressed.
Figure 37B:
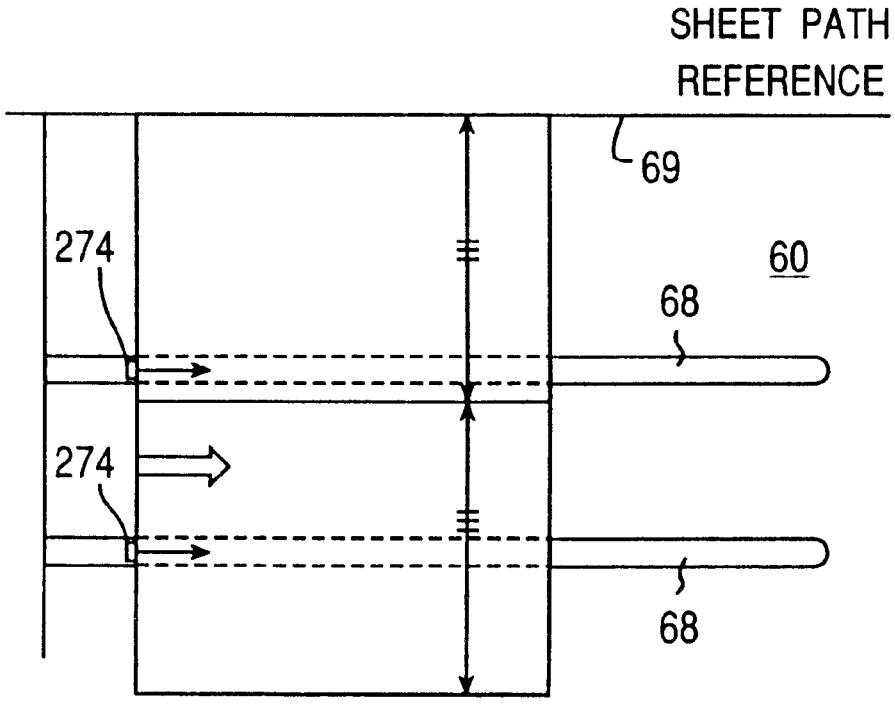

When the refeed levers 274 are to press the rear end of a minimum-size document, only the refeed lever 274 on the sheet path side presses as shown in FIG. 37A, the press being effected at a position falling outside ½ of the widthwise length of the document from the fixed document-restricting plate 69. Also, when the refeed levers 274 are to press the rear end of a maximum-size document, the two refeed levers 274 press the document as shown in FIG. 37B, the press being effected at a position intermediate of the two refeed levers 274, falling outside ½ of the widthwise length of the document from the fixed document-restricting plate 69. For this reason, in either case, the document moves while keeping in contact with the document restricting plate 69 on the sheet path side, thus never being separated from the sheet path standard.

In addition, for cases in which the press is effected by the two refeed levers 274, the outer refeed lever 274 may be preliminarily protruded on the downstream side of the inner refeed lever 274 in the document feed direction, in order that the outer refeed lever 274 primarily presses the document.

Preferably, the grooves 68 of the document tray 60 are provided at such places that the widthwise end of the document will not stretch over the grooves, in order to prevent the document from any obstruction in move or the occurrence of document jam.

In the document refeed moving section 270 of the above-described constitution, with the document recirculation mode set, when all the document sheets have been discharged, the document moving motor M5 rotates forward, causing the moving belt 271 to move. Accordingly, the slider 273 slides to a specified move amount corresponding to the document size on the guide rail 272 from the home position toward the downstream side of the document feed direction. As a result of this, the refeed levers 274 press the rear end of the discharged document sheet, thereby moving the discharged document sheet to the feed port 61. Then, when the front end of the document sheet makes contact with the end restricting plate 81 of the document feed section 80, causing the empty sensor SE1 to turn on, document sheets are refed. Meanwhile, the refeed levers 274 return to the home position.

In the normal document copying mode in which the document recirculation mode has not been selected, the discharged document sheets are moved by the refeed levers 274 to easy-to-take out places in the center of the document tray 60.

In addition, the document refeed moving section 270 is capable of the following control operations.

By providing an on-discharge-tray sensor SE4 (see FIG. 4) for detecting document sheets discharged onto the document tray 60, the refeed levers 274 are so arranged to be moved only on conditions that the on-discharge-tray sensor SE4 has been turned on and that the empty sensor SE1 has been turned off. With this arrangement, if discharged document sheets are erroneously taken out by the user upon completion of document discharge despite the selection of the document recirculation mode, the on-discharge-tray sensor SE4 turns off so that the refeed levers 274 will not operate, thus avoiding wasteful operations.

Also, if the empty sensor SE1 is turned on during the move or return to the home position of the document sheets by the refeed levers 274, the refeed levers 274 are stopped from returning operation. With this arrangement, even if the user has erroneously placed the next document sheets or any obstacle on the document tray 60, the empty sensor SE1 detects this, causing the refeed levers 274 to be stopped from returning. Thus, the refeed levers 274, the document sheets and the obstacle are prevented from being damaged.

If the empty sensor SE1 does not turn on even by moving the refeed levers 274 to the predetermined amount depending on the document size, then the refeed levers 274 are moved further to a specified amount. With this arrangement, even if the apparatus has misdetected the document size as one size smaller, the document sheets can be moved to the feed port 61 reliably, thus allowing the document sheets to be refed.

If the empty sensor SE1 does not turn on by moving the refeed levers 274 to the predetermined amount depending on the document size, and if the sheet-feed empty sensor does not turn on by moving the refeed levers 274 further to the specified amount, then the refeed levers 274 are stopped from moving. With this arrangement, even if document sheets are taken out by the user during the move of the refeed levers 274, the refeed levers 274 are stopped from moving, thus avoiding wasteful operations.

When the discharge sensor is off before the move of the refeed levers 274, the refeed levers 274 are prevented from moving. With this arrangement, if the user erroneously takes out the document sheets upon completion of the document discharge despite the selection of the recirculation mode, the discharge sensor turns off so that the refeed levers 274 will not operate, thus avoiding wasteful operations.

By providing a different-size detecting means for detecting any inclusion of document sheets of different sizes in a comparison of the size of the first document sheet detected by the document size detecting means with the document sizes of subsequent document sheets, the refeed levers 274 are prevented from operating if any inclusion of different sizes of document sheets is detected by the different-size detecting means, in the case where any one of the count mode, the automatic recirculation copying mode and the automatic jam correction mode has been selected. With this arrangement, occurrence of misfeeds of sheets can be prevented.

It is preferable to provide alarm means for issuing an alarm when the refeed levers 274 are disabled to operate. With this arrangement, the user can be urged to set the document manually to the feed port 61. In this case, the operation is preferably started when the start key is pressed with all the document sheets set on the document tray after the alarm means has issued the alarm. With this arrangement, the user can be forced to press the start key so that the copying process can be resumed without fail.

With the automatic jam correction mode selected, the sweep-out and idly feed processes are carried out by conveying the document sheets at the highest possible speed. The document feeding speed herein referred to is preferably the drivable highest speed possible in terms of hardware configuration of the document conveying apparatus. With this arrangement, the sweep-out and idle feed processes without copying process can be carried out in short time, so that the wait time can be reduced.

What is claimed is:

1. A sheet conveying apparatus comprising: a tray which couples a feed port and a discharge port to each other by a continuous surface, the tray comprising:

a first surface adjacent to the feed port for placing thereon sheets to be fed;

a second surface adjacent to the discharge port for placing thereon discharged sheets, the second surface being tilted up so that the front end of the discharged sheet is positioned above the rear end thereof; and a bent portion at which the end of the first surface at the discharge side and the end of the second surface at the feed side are coupled to each other, wherein a length of the first surface ranging from the bent portion to the feed port in the sheet conveyance direction is larger than one half of the length of a feedable maximum size sheet in the sheet conveyance direction, and wherein a length of the second surface ranging from the discharge port to the bent portion in the sheet conveyance direction is larger than one half of the length of a feedable minimum size sheet in the sheet conveyance direction.

2. The sheet conveying apparatus according to claim 1, wherein a height of the tray from the bent portion to the discharge port in the direction of gravity is larger than the height of sheets when there is a maximum load of sheets placed on the second surface.

3. The sheet conveying apparatus according to claim 1, wherein the tray is formed with a recess extending from a side wall of the tray toward the middle of the tray.

4. The sheet conveying apparatus according to claim 1, further comprising:

a moving mechanism for moving the discharged sheets discharged on the second surface of the tray to the feed position on the first surface;

a sensor for detecting the movement of the discharged sheets to the feed position; and a pressing plate for pressing the front end of the sheet when the sensor detects the movement of the discharged sheets to the feed position.

5. The sheet conveying apparatus according to claim 1, further comprising a fixed sheet-restricting plate and a movable sheet-restricting plate for restricting the movement of the sheet in a direction perpendicular to the sheet conveying direction, wherein a spacing between the fixed sheet-restricting plate and the movable sheet-restricting plate on the discharge side in the direction perpendicular to the sheet conveying direction is wider than that on the feed side.

6. The sheet conveying apparatus according to claim 5, wherein a spacing between a discharge side end of the movable sheet-restricting plate and the discharge port is smaller than the length of the minimum-size sheet in the sheet conveying direction.

7. A copying machine comprising:

a document conveying apparatus which feeds documents to an exposure position and discharges the document; and an image forming apparatus which executes a copying process of the document synchronously with the feed and the discharge operations of the document conveying apparatus, the document conveying apparatus being equipped with a tray which couples a feed port and a discharge port to each other by a continuous surface, wherein the tray comprises:

a first surface adjacent to the feed port for placing thereon documents to be fed;

a second surface adjacent to the discharge port for placing thereon discharged documents, the second surface being tilted up so that the front end of the discharged document is positioned above the rear end thereof; and a bent portion at which the end of the first surface at the discharge side and the end of the second surface at the feed side are coupled to each other, wherein a length of the first surface ranging from the bent portion to the feed port in the document conveyance direction is larger than one half of the length of a feedable maximum size document in the document conveyance direction, and wherein a length of the second surface ranging from the discharge port to the bent portion in the document conveyance direction is larger than one half of the length of a feedable minimum size document in the document conveyance direction.

8. The copying machine according to claim 7, wherein a height of the tray from the bent portion to the discharge port in the direction of gravity is larger than the height of documents when there is a maximum load of documents on the second surface.

9. The copying machine according to claim 7, wherein the tray is formed with a recess extending from a side wall of the tray toward the middle of the tray.

10. The copying machine according to claim 7, further comprising:

a moving mechanism for moving the discharged documents discharged on the second surface of the tray to the feed position on the first surface;

a sensor for detecting the movement of the discharged documents to the feed position; and a pressing plate for pressing the front end of the document when the sensor detects the movement of the discharged documents to the feed position.

11. The copying machine according to claim 7, further comprising a fixed document-restricting plate and a movable document-restricting plate for restricting the movement of the document in a direction perpendicular to the document conveying direction, wherein a spacing between the fixed document-restricting plate and the movable document-restricting plate on the discharge side in the direction perpendicular to the document conveying direction is wider than that on the feed side.

12. The copying machine according to claim 11, wherein a spacing between a discharge side end of the movable document-restricting plate and the discharge port is smaller than the length of the minimum-size document in the document conveying direction.

* * * * *